United States Patent [19]

Lynch

[11] Patent Number: 4,982,721

[45] Date of Patent: Jan. 8, 1991

[54] RESTRICTED INTAKE COMPENSATION METHOD FOR A TWO STAGE FURNACE

[75] Inventor: Gregory A. Lynch, Murfreesboro, Tenn.

[73] Assignee: Inter-City Products Corp. (USA), Lavergne, Tenn.

[21] Appl. No.: 477,743

[22] Filed: Feb. 9, 1990

[51] Int. Cl.[5] ..... F24H 3/00

[52] U.S. Cl. ..... 126/116 A; 431/12; 431/19; 431/62; 431/90

[58] Field of Search ..... 431/12, 19, 20, 62, 431/90; 126/116 R, 116 A; 236/10, 1 EP, 11

[56] References Cited

U.S. PATENT DOCUMENTS

| | | | |
|---|---|---|---|
| 4,251,025 | 2/1981 | Bonne et al. | 236/14 |
| 4,334,855 | 6/1982 | Nelson | 431/20 |
| 4,340,355 | 7/1982 | Nelson et al. | 431/20 |
| 4,373,662 | 2/1983 | Bassett et al. | 236/10 |
| 4,421,268 | 12/1983 | Bassett et al. | 236/10 |
| 4,451,226 | 5/1984 | Landis et al. | 431/15 |
| 4,502,625 | 3/1985 | Mueller | 236/11 |
| 4,638,942 | 1/1987 | Ballard et al. . | |
| 4,648,551 | 3/1987 | Thompson et al. . | |
| 4,703,747 | 11/1987 | Thompson et al. . | |
| 4,706,881 | 11/1987 | Ballard . | |
| 4,729,207 | 3/1988 | Dempsey et al. | 126/116 A |
| 4,773,586 | 9/1988 | Ryan . | |
| 4,789,330 | 12/1986 | Ballard et al. . | |
| 4,792,089 | 12/1988 | Ballard . | |
| 4,842,510 | 6/1989 | Grunden et al. . | |
| 4,887,767 | 12/1989 | Thompson et al. . | |
| 4,907,737 | 3/1990 | Williams, Jr. | 236/11 |

*Primary Examiner*—Carroll B. Dority

*Attorney, Agent, or Firm*—Jeffers, Hoffman & Niewyk

[57] ABSTRACT

The present invention discloses a method of compensating for a restricted intake in a two stage furnace. The furnace includes low and high pressure switches for determining if sufficient air is present to support low and high combustion. When the furnace operates at high combustion, the state of the high pressure switch is monitored to determine if the high pressure switch has changed state for a predetermined amount of time such as 15 seconds. The inducer fan is switched to low when insufficient air for high combustion has been indicated for such a predetermined time. If the state of the low pressure switch indicates that insufficient air is available for low combustion, then the inducer is turned on high.

4 Claims, 19 Drawing Sheets

RESTRICTED INTAKE COMPENSATION METHOD FOR A TWO STAGE FURNACE

BACKGROUND OF THE INVENTION

The present invention relates to two stage furnaces. Specifically the field of the invention is that of controls for two stage furnaces.

Conventional one stage furnaces cycle on and off to maintain a desired level of heat within a building. In operation, a thermostat senses a predetermined deviation from the desired temperature and activates the furnace. The furnace heats air which is circulated throughout the building. When the thermostat senses that the indoor temperature has reached the desired temperature, the furnace is shut down.

Conventional two stage furnaces also cycle on and off to maintain a desired level of heat, but can provide a more uniform flow of heat with greater efficiency. One prior art system uses timers to activate the two furnace stages in a predetermined sequence, the timing sequence being permanently programmed or dynamically alterable. In another prior art system, the furnace provides the low stage when the temperature differential is relatively low, and the high stage is provided during periods when the differential is relatively high. Thus, the operation of the furnace tends to match the heat demand of the building. However, problems exist concerning the prior art two stage furnaces.

One significant disadvantage with the prior art two stage furnaces is that they require expensive microprocessors and associated circuitry. One of the largest components of the cost of a furnace control is the circuitry of the microprocessor, so minimizing the complexity of controller board greatly reduces the total cost. Prior art control systems typically require a sophisticated microprocessor and substantial amount of supporting circuitry such as ROM and RAM.

Another disadvantage with the prior art involves the arrangement of temperature and pressure switches. Such switches are tested by the microprocessor which then executes the appropriate corrective steps. However, this requires that the switches be checked by the microprocessor for errors, after which the microprocessor independently executes the appropriate corrective steps by operating other elements of the system. Only the microprocessor can interrupt operation, and it must rely on external connections to implement an interruption.

An additional disadvantage concerns the comfort level provided by the prior art furnaces. The cycling of the furnace often begins with a blast of relatively cold air from a high speed circulator which is undesirable for the comfort of the occupants. A more desirable outcome would involve having warm air circulated immediately after the circulator fan starts s the occupants of the building are provided optimal heating.

A further disadvantage relates to condensation in the heat exchangers. The heat exchangers generally take longer to heat up during the low stage, which allows corrosive moisture to accumulate in the heat exchangers while warming up. Such condensation can shorten the useful life of the heat exchangers.

What is needed is a control for a two stage furnace which minimizes the cost of the microprocessing circuitry, which provides for redundancy in checking the temperature and pressure switches, which provides for better levels of comfort, and which minimizes the condensation in the heat exchangers.

SUMMARY OF THE INVENTION

The present invention is an integrated two stage furnace control which combines relatively simple and inexpensive components to deliver a full range of functions.

The present invention employs an integrated circuit which enables the control circuitry to be minimized. In the disclosed embodiment, microprocessor based circuitry is used with nonvolatile memory. A processor, a relay, and a relatively small amount of memory is used to control the operation of the furnace. The control unit provides a fully functional control for sequencing the operation of the furnace. The external temperature and pressure switches can be tested by the control unit to provide information useful in decision making.

The furnace control of the present invention is adapted for use with a hot surface ignitor which minimizes power surges in the control, thus prolonging its useful life. The hot surface ignitor draws a steady amount of power, and does not require additional circuitry to provide the appropriate level of power.

Further, the external temperature and pressure switches directly control the power supplied to the gas valve. Instead of relying solely on the processor to test the various switches and directly control the gas valve, the opening of any of the switches deenergizes the circuit to the gas valve. The present invention provides a redundancy in the control of the furnace because either the processor or any one of the switches can deenergize the circuit to the gas valve.

The control of the present invention provides an improved comfort level for the building occupant during the initial portion of a heating cycle. A circulator fan initially on low speed provides the building with a relatively warm flow of conditioned air during the heat exchanger warmup portion while the inducer fan and gas valve are operating at high combustion. The occupant is provided heated air during the warming period of the heat exchanger without unduly interfering the warming. Thus, the furnace provides a superior comfort level while operating efficiently.

The method of warming the furnace minimizes the occurrence of corrosive condensate within the heat exchangers of the furnace. After a short lighting time period with the inducer fan and the gas valve on low, for example six seconds, the furnace quickly warms up because the inducer fan and the gas valve run on high for a heat exchanger warm up time period, for example 60 seconds. A greater amount of condensate occurs when the heat exchangers only gradually heat up, so that a significant time gap exists between initial condensate formation and when the heat exchangers have reached a temperature which vaporizes the moisture. The control of the present invention minimizes the amount of condensate by quickly ramping the heat exchangers to their operating temperature.

The present invention, in one form, involves a restricted air compensation method and control for a two stage furnace. The two stage furnace includes a plenum, a gas burner, a gas valve having a low and high combustion operating setting, and an inducer fan having a low and high speed operating setting. Also included are a low and high pressure switch for determining if the air pressure inside the plenum indicates sufficient air is present for the gas burner to support low and high combustion, respectively. First, the furnace is operated at high combustion when high heat is enabled by operating the inducer fan at the high speed setting. During high combustion, the state of said high pressure switch is determined including timing the duration of the state changes of the high pressure switch. Next, the inducer fan is switched to the low speed setting when the high pressure switch has indicated that insufficient air was present to support high combustion for a predetermined time period. During low combustion the state of the low pressure switch is determined and when insufficient air for low combustion is indicated, the inducer fan is switched to the high speed setting.

One object of the present invention is to provide a two stage furnace control which fully functions with a minimal amount of control circuitry.

Another object of the present invention is to provide a two stage furnace control using cost effective integrated circuit technology in combination with the external temperature and pressure switches.

An additional object of the present invention is to provide a two stage furnace control wherein the external switches directly control the supply of power to the gas valve.

A further object is to provide an improved comfort level to occupants of buildings having a two stage furnace control of the present invention.

Still another object is to provide a control which uses a method that minimizes condensate within the heat exchangers.

BRIEF DESCRIPTION OF THE DRAWINGS

The above mentioned and other features and objects of this invention, and the manner of attaining them, will become more apparent and the invention itself will be better understood by reference to the following description of and embodiment of the invention taken in conjunction with the accompanying drawings, wherein.

Figure 1:
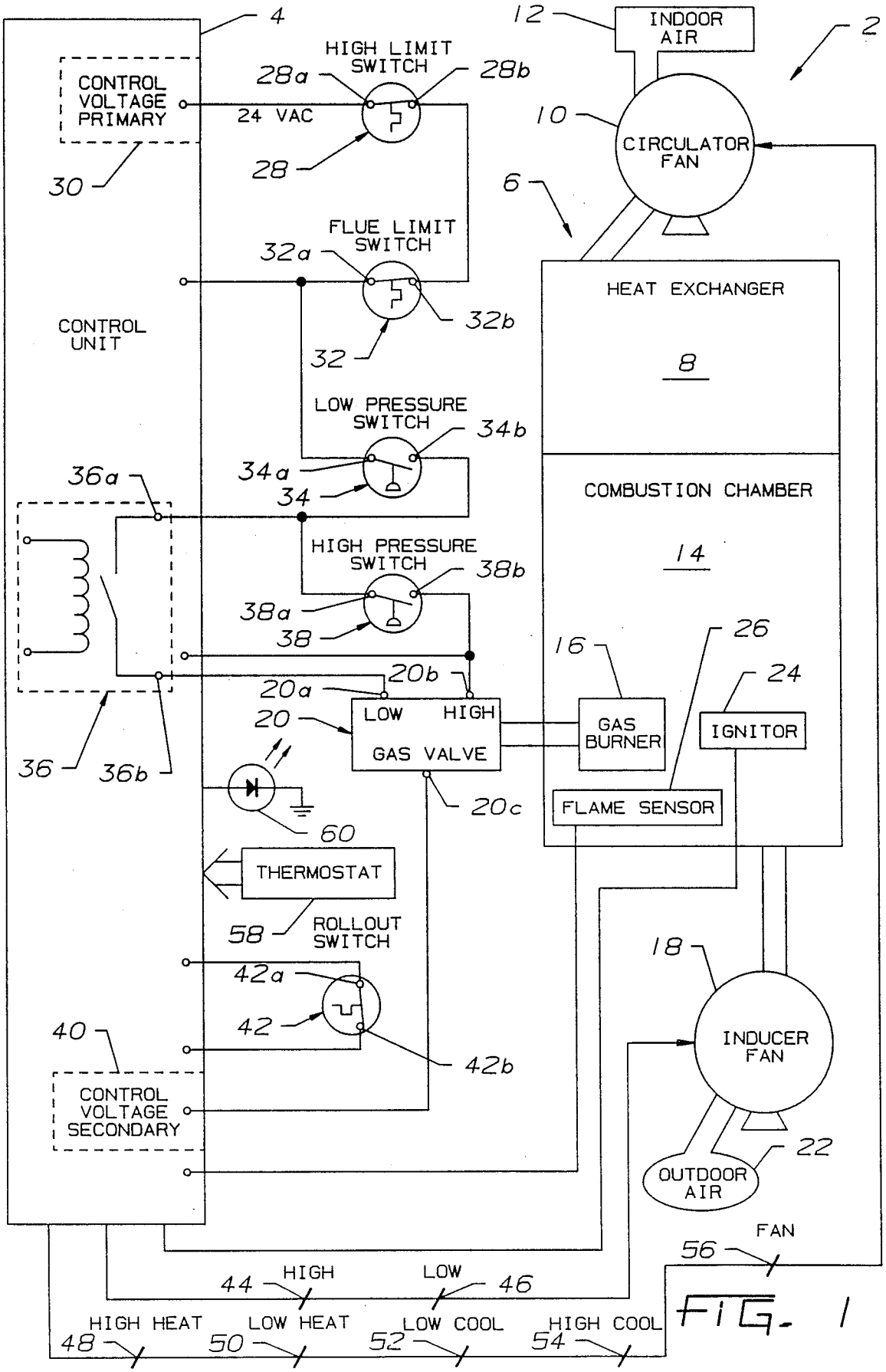
FIG. 1 is a schematic diagram of the two stage furnace of the present invention.

Corresponding reference characters indicate corresponding parts throughout the several views. The exemplifications set out herein illustrate a preferred embodiment of the invention, in one form thereof, and such exemplifications are not to be construed a limiting the scope of the invention in any manner.

DESCRIPTION OF THE PREFERRED EMBODIMENT

The present invention relates to a two stage furnace 2 as shown in FIG. 1. The present invention is particularly concerned with control unit 4 which includes a processor and associated circuitry. Control unit 4 comprises a processor, nonvolatile memory for programming, and other circuitry as described below. However, the invention encompasses other arrangements of control circuitry which control operation of a two stage furnace.

Control unit 4 operates in conjunction with plenum 6 of furnace 2. Plenum 6 includes a heat exchanger portion 8 which has at least one heat exchanger (not shown) and ducts (not shown) in communication with circulator fan 10. Indoor air 12 is heated by circulator fan 10 circulating air through heat exchanger portion 8 and back into a building (not shown). Circulator fan 10 should have at least two speed settings, one for a first stage of heat and one for a second stage of heat. In the exemplary embodiment, circulator fan 10 includes a brushless, permanent magnet (BPM) motor which is variable in speed and has 10 speed taps. However, circulator fan 10 may have more speed settings as desired for the particular application. Circulator fan 10 includes two heat speed settings, one for high heat and one for low heat. The BPM motor maintains a constant torque to compensate for changes in static pressure. Circulator fan 10 requires approximately 15 to 20 seconds to change its speed after its speed setting is changed, which reduces the noise. In addition, speeds for a fan only or a cool cycle may be included.

Combustion chamber 14 supplies heat by means of gas burner 16 and inducer fan 18, and thermally contacts heat exchanger portion 8. Gas burner 16 receives combustion fluid (e.g., natural gas or propane) from gas valve 20 and outdoor air 22 from inducer fan 18, and combines the fluids to produce a combustion mixture which burns to warm heat exchanger portion 8. Inducer fan 18 comprises a two speed motor for running at either high heat speed or low heat speed setting. Gas valve 20 has a low terminal **20*a* and a high terminal 20*b*** for activating a low heat level and a high heat level of combustion. Combustion chamber 14 further includes a hot surface ignitor 24 for initiating combustion, and flame sensor 26 for detecting a flame at gas burner 16. Flame sensor 26 is positioned in the path of the flame from gas burner 16.

The heat speed settings of circulator fan 10 are adapted to match the settings of inducer fan 18 and gas valve 20. Similarly, inducer fan 18 is adapted to provide sufficient air for the amount of fuel supplied by gas valve 20. Thus, when gas valve 20 is set on low for low heat, inducer fan 18 runs on low to provide an adequate combustion mixture and circulator fan 10 runs on low to extract substantially all the heat produced. When gas valve 20 is set on high for high heat, inducer fan 18 runs on high to provide an adequate combustion mixture and circulator fan 10 runs on high to extract substantially all the heat produced. During most conditions, the setting of circulator fan 10, inducer fan 18, and gas valve 20 match. However, at certain points in the operation of furnace 2 the settings may not match, as described more particularly below.

Also, pressure and temperature switches are present in plenum 6 and are described below, although the switches are shown separately for clarity. High limit switch 28 is in thermal communication with heat exchanger portion 8 for detecting when the temperature exceeds a predetermined limit. Under normal operating conditions high limit switch 28 is closed, however, when the temperature of heat exchanger portion 8 rises to a predetermined level such that the heated conditioned air exceeds a certain level, for example 185° F., high limit switch 28 opens. Terminal **28*a* of high limit switch 28 is coupled to control voltage primary 30, which supplies power to gas valve 20. Terminal 28*b* of high limit switch 28 is coupled to terminal 32*b* of flue limit switch 32**.

Flue limit switch 32 is in thermal communication with combustion chamber 14 and operates similarly to high limit switch 28. However, flue limit switch 32 reacts to temperature sensed from the flue gases, and opens when the temperature of the flue gases rises to a predetermined level, for example 130° F. Terminal **32*a* of flue limit switch 32 has a return to control unit 4, so that control unit 4 can test the circuit including high limit and flue limit switches 28 and 32 to determine if at least one of the two has opened. Terminal 32*a* of flue limit switch 32 is also coupled to terminal 34*a* of low pressure switch 34**.

Low pressure switch 34 is located in communication with combustion chamber 14 for determining if sufficient outside air 22 is being provided for a low heat level of combustion, or low combustion. When inducer fan 18 is not running, low pressure switch 34 is open. Low pressure switch 34 closes when a predetermined pressure occurs in combustion chamber 14. The predetermined pressure for closing low pressure switch 34 corresponds to a pressure that allows sufficient outdoor air 22 to support low combustion, which varies for the size and arrangement of a particular furnace. Both terminals **34*a* and 34*b* of low pressure switch 34 are coupled to control unit 4 so that switch 34** can be directly tested.

Terminal **34*b* of low pressure switch 34 is coupled to terminal 36*a* of relay switch 36 and terminal 38*a* of high pressure switch 38. Relay switch 36 can be any suitable interrupting switching device. Terminal 36*b* of relay switch 36 is coupled to low terminal 20*a* of gas valve 20 so that control unit 4 can turn on the low heat level of gas flow. When switches 28, 32, and 34 are closed and control unit 4 closes relay switch 36, a closed circuit is formed from control voltage primary 30 to low terminal 20*a* of gas valve 20, which also has return terminal 20*c* coupled to control voltage secondary 40. Control voltage secondary 40 is the return of control voltage primary 30, which in the exemplary embodiment provides a 24 volt alternating current (24 VAC) for energizing gas valve 20. The same circuit that energizes low terminal 20*a* of gas valve 20 also controls the redundant stage of gas valve 20**.

High pressure switch 38 is located in communication with combustion chamber 14 for determining if sufficient outside air 22 is being provided for a high heat level of combustion, or high combustion. When inducer fan 18 is not running on high heat speed, high pressure switch 38 is normally open. High pressure switch 38 closes when a predetermined pressure occurs in combustion chamber 14. The predetermined pressure for closing high pressure switch 28 corresponds to a pressure that allows sufficient outdoor air 22 to support high combustion, which varies for the particular size and arrangement of a particular furnace. Both terminals **38*a* and 38*b* of high pressure switch 38 are coupled to control unit 4 so that switch 38** can be directly tested.

Terminal **38*b* of high pressure switch 38 is coupled to high terminal 20*b* of gas valve 20 so that the high heat level of gas flow can be activated. When switches 28, 32, and 34 are closed and the pressure inside combustion chamber 14 reaches a predetermined level, high pressure switch 38 closes and forms a closed circuit from control voltage primary 30 to high terminal 20*b* of gas valve 20, from return terminal 20*c* which is coupled to control secondary voltage 40**.

High pressure switch 38 may intermittently open and close while the inducer fan operates at the high speed setting, especially during initial operation. Control unit 4 generally operates inducer fan 18 and circulator fan 10 according to the state of high pressure switch 38, which directly controls the setting of gas valve 20. However, control unit 4 only alters the settings of fans 18 and 10 after high pressure switch 38 has maintained a changed state for more than a predetermined time period, for example 15 seconds. As described in more detail below, when operating at high combustion and high pressure switch 38 remains open for 15 seconds, then control unit 4 switches circulator fan 10 to the low speed setting to cool low combustion which gas valve 20 should be producing because the circuit to high terminal **20*b* is open. Conversely, when operating at low combustion and high pressure switch 38 remains closed for 15 seconds, then control unit 4 switches circulator fan 10 to the high speed setting to cool high combustion which gas valve 20 should be producing because the circuit to high terminal 20*b*** is closed.

Another temperature sensor, rollout switch 42, is located adjacent to combustion chamber 14 for detecting the presence of a flame beyond the expected area of combustion. Rollout switch 42 is coupled at both terminals **42*a* and 42*b* to control unit 4, so that control unit 4 can directly test switch 42. Although not shown, rollout switch 42 can also be coupled in series with high limit switch 28 and flue limit switch 32 to provide an additional safety check in furnace 2. Normally closed, rollout switch 42 opens when a flame is sensed. Although rollout switch 42 closes when no flame is sensed, control unit 4** requires a manual reset at the thermostat before furnace 2 is enabled to operate, see the ROLLOUT routine described below.

In addition to being coupled to the temperature and pressure sensors, control unit 4 is coupled to ignitor 24 and flame sensor 26 for regulating combustion in furnace 2. Inducer high line 44 and inducer low line 46 also couple control unit 4 to inducer fan 18 so that two different speed levels can be activated, a high heat speed and a low heat speed, respectively. Circulator high heat line 48, circulator low heat line 50, circulator low cool line 52, circulator high cool line 54, and circulator fan line 56 couple control unit 4 to circulator fan 10 so that five different speed levels can be activated, a high heat speed setting, a low heat speed setting, a low cool speed setting, a high cool speed setting, and a continuous fan setting.

Control unit 4 is also coupled to thermostat 58 in a conventional manner to receive signals indicating if a call for low heat, high heat, or cool is present. For a call for cool, control unit 4 operates circulator fan 10 to direct air through compressor coils (not shown), and operates furnace 2 to end the heating cycle, while thermostat 58 controls air cooling equipment (not shown) to lower the temperature of indoor air 12. The thermostat must be able to communicate the need for high and low heat so that the appropriate stage of heat can be provided by furnace 2. Also, furnace 2 accommodates a fan only signal that indicates circulator fan 10 should be enabled at a fan speed setting without heating plenum 6. Further, a call for cool should be ascertainable from thermostat 58 because operation of furnace 2 can differ when thermostat 58 changes from heat to off or heat to cool.

Figure 4:
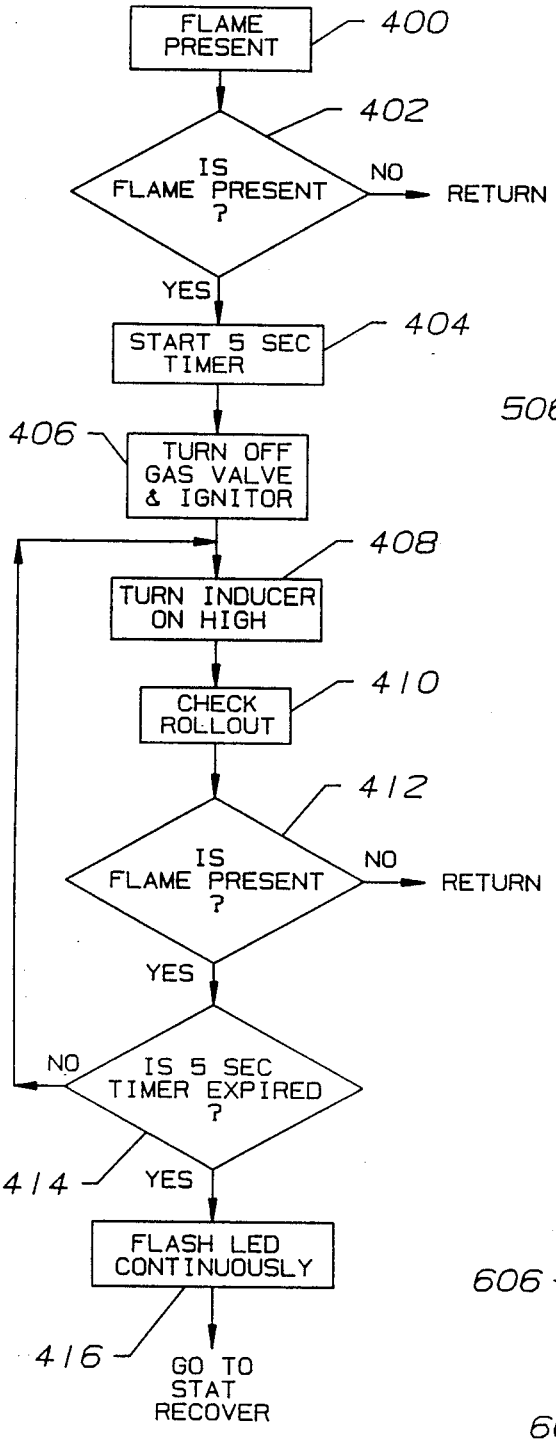
FIG. 4 is a flow chart of the FLAME PRESENT routine.

LED 60 is coupled to control unit 4 which sets LED 60 to flash a predetermined number of times thus indicating various fault conditions in furnace 2. At power-up, LED 60 flashes once. Thereafter, control unit 4 can set LED 60 to flash continuously when a flame is indicated by flame sensor 26 (see FIG. 4), or to remain on continuously to indicate a failure in control unit 4 (see FIG. 7). For other fault conditions, control unit 4 sets LED 60 to flash a certain number of times so that LED 60 activates for approximately 0.25 seconds, then pauses for approximately 0.25 seconds before flashing again. Each group of flashes is separated by approximately 2 seconds. The following table shows the number of flashes and the corresponding fault:

| Flashes | Fault Condition | Figure |
|---|---|---|
| 1 | System lockout for failed ignition | 20 |
| 2 | Low Pressure Switch closed | 9 |
| 3 | Low Pressure Switch open | 9,17 |
| 4 | High Pressure Switch closed | 17,24 |
| 5 | High Pressure Switch open | 19,21B,23 |
| 6 | High Limit Switch open | 11 |
| 7 | Rollout Switch open | 6 |
| 8 | Circulator motor fault | 5 |
| 9 | Low Pressure Switch closed/High Inducer | 16 |

Using the number of flashes displayed by LED 60, an on-site technician can quickly ascertain the general problem are in a malfunctioning furnace. More particular descriptions of the fault conditions are given in the descriptions of the corresponding Figures below.

THE MAIN OPERATING LOOP

Figure 2:
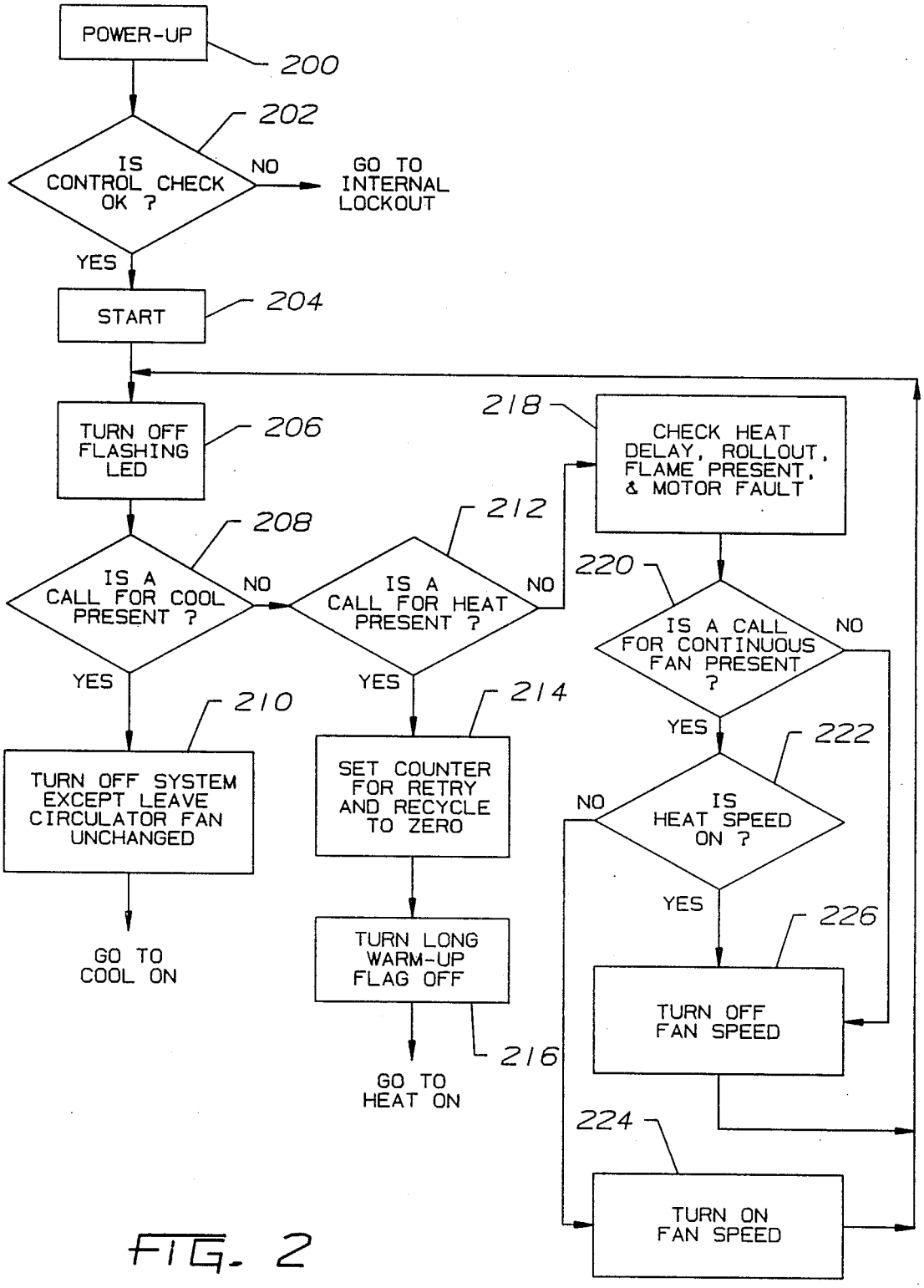
FIG. 2 is a flow chart of the main operating loop of the two stage furnace control.

The basic operating sequence of the present invention begins with POWER UP 200 (See FIG. 2). The control unit first performs a control check in step 202 to determine if all the internal systems in the control unit appear operative. This check includes comparing preprogrammed non-volatile memories, for example ROM memory, for any discrepancies which would indicate a memory failure. If the unit fails the control check, then the control unit shuts down by executing INTERNAL LOCKOUT, which is described below. START 204 refers to the beginning of the main operating loop shown in the flow chart of FIG. 2, and does not necessarily represent any process step or steps.

At step 206, the first of the operating loop, the control unit turns off the LED if it was flashing, thereby signifying normal operating conditions. Then the control unit checks for a call for cool from the thermostat in step 208. If a call for cool is present, at step 210 every component in the system is turned off, except for the circulator fan which remains unchanged, and the control unit begins to execute the cooling cycle in the COOL ON operation which is described below. However, if no call for cool exists when step 208 is performed, the control unit checks for a call for heat in step 212. If a call for heat exists in step 212, the retry and recycle counters are set to zero in step 214, the long warmup flag is turned off in step 216, and the control unit begins to execute the heating cycle in the HEAT ON operation which is described below.

When neither cool or heat are called for, the control unit performs fault checking and determines if a continuous fan setting is selected. In step 218, checks for HEAT DELAY, ROLLOUT, FLAME PRESENT, and MOTOR FAULT are made, which are described below. The checks of step 218 serve to coordinate the sequencing of the circulator fan after a call for heat (in HEAT DELAY) and to alter operation if an abnormality is sensed near the gas burner (in ROLLOUT and FLAME PRESENT) or the circulator fan (in MOTOR FAULT).

After the fault checks, the control unit checks for a call for a continuous fan in step 220. If such a call exists, the control unit determines whether a heat speed is activated in step 222. Assuming that the heat speeds are off, the circulator fan speed is turned on in step 224. If no call for continuous fan exists in step 220, or the heat speed is on in step 222, the circulator fan speed is turned off in step 226. After the speed of the circulator fan has been appropriately set in either step 224 or 226, the control unit restarts the main operating loop at step 206.

THE COOL CYCLE

Figure 3:
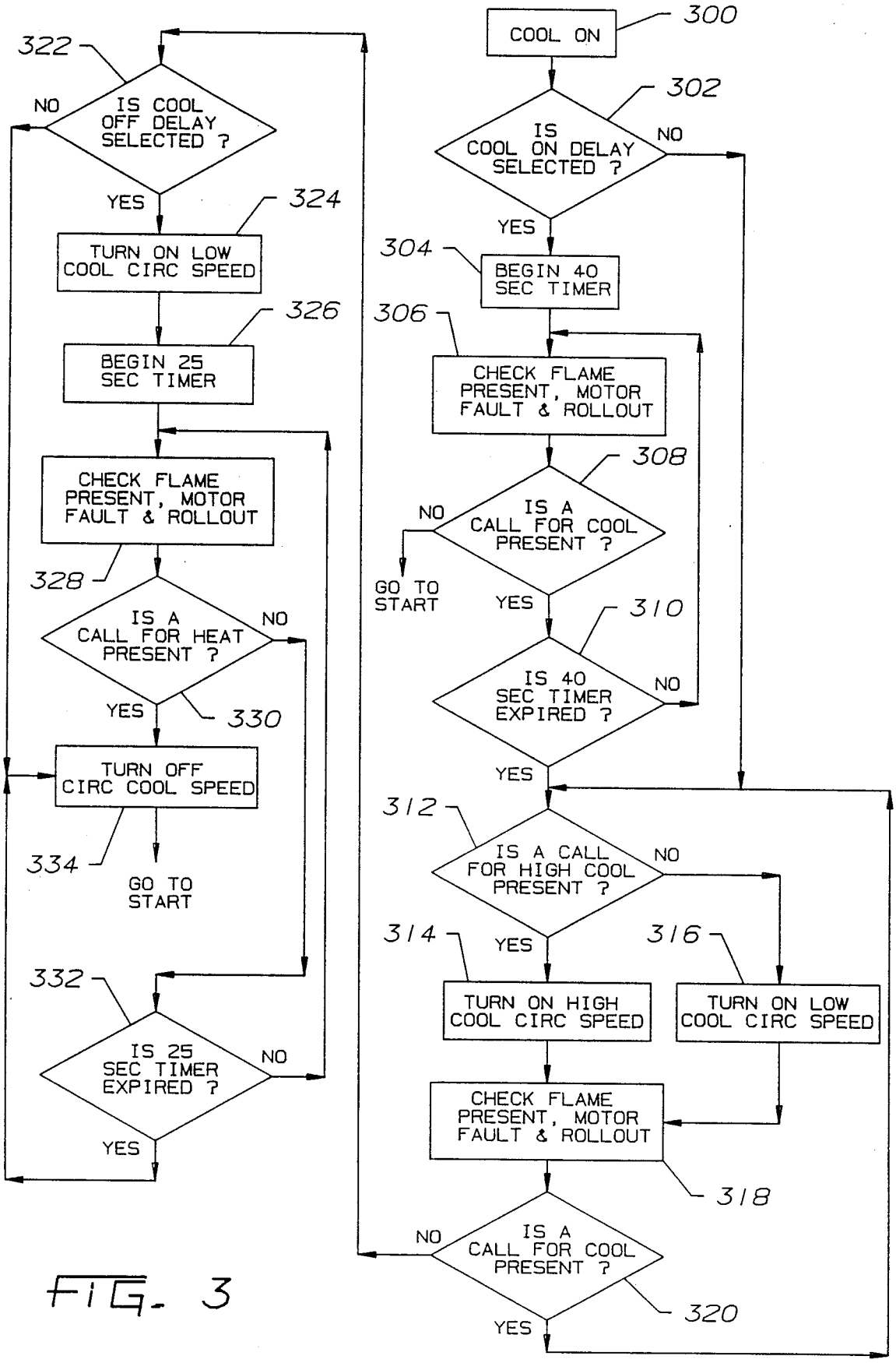
FIG. 3 is a flow chart of the operation of COOL ON cycle.

The COOL ON 300 operation is shown in the flow chart of FIG. 3. The thermostat directly controls the compressor of the cooling equipment, therefore the control unit normally only activates the circulator fan for drawing air through compressor coils during the cooling cycle. As the first step of the COOL ON operation, the control unit determines if a cool on delay has been selected in step 302. The cool on delay can be selected by means including preprogrammed ROM memory, non-volatile EPROM or EEPROM memory, or a DIP switch. If the control determines a cool on delay was selected, a 40 timer is started at step 304. Next, step 306 includes checks for FLAME PRESENT, MOTOR FAULT, and ROLLOUT. In the succeeding step 308, the control unit checks for the existence of a call for cool. If a call for cool no longer exists, then the COOL ON operation is exited and execution returns to the START portion of the main operating loop. Assuming a call for cool still exists, the 40 second timer is checked to see if the time has expired, and if time remains on the timer, the control unit loops back to execute step 306.

After the cool on delay is completed, or if cool on delay was not selected, the control unit begins the cooling operation by determining the existence of a call for high cool in step 312. If a call for high cool exists then the circulator fan is turned on high cool speed in step 314, else the circulator fan is turned on low cool speed in step 316. After either case, the control unit performs checks for FLAME PRESENT, MOTOR FAULT, and ROLLOUT in step 318. After step 318, the control unit determines if a call for cool still exists, and if so then loops back to execute step 312.

When a call for cool no longer exists, execution of the COOL ON operation continues with step 322 for determining if a cool off delay has been selected. The cool off delay can be selected by means similar to selecting the cool on delay. If the cool off delay is not selected, the control unit initiates exiting the cooling cycle by performing step 334. Otherwise, the circulation fan is turned on low cool speed in step 324. After turning on the circulation fan to low cool speed in step 324, the control unit initiates a 25 second timer at step 326. Next, the control unit performs checks for FLAME PRESENT, MOTOR FAULT, and ROLLOUT in step 328, followed by checking for the existence of a call for heat in step 330. If no call for heat exists, then the 25 second timer is polled in step 232 and the control unit execute to execute step 328 if time has not expired.

In the event a call for heat was present in step 330, or the expiration of the 25 second timer in step 232, the control unit turns off the circulator cool speed in step 334 and the control unit begins to execute the main operating loop at START and thus exits the cooling cycle.

FLAME PRESENT

During COOL ON, three fault condition routines are called. The one fault routine checks for the presence of flame at the gas burner, namely FLAME PRESENT routine 400 of FIG. 4. First, the control unit directly determines if the flame sensor detects a flame in step 402. If no flame is indicated, then the FLAME PRESENT routine is completed and execution resumes at the point directly after FLAME PRESENT was called. The sequence of the control unit resuming execution at the point directly after a routine is completed execution is termed "RETURN".

However, if a flame is indicated, then the control unit attempts to stop the flame. First, the control unit initiates a 5 second timer in step 404, and the control unit turns off the gas valve and the ignitor in step 406. With the gas valve and ignitor off, the inducer fan is turned on high in step 408. The control unit performs a ROLLOUT check in step 410, followed by directly checking the flame sensor in step 412. If no flame is indicated, then the routine is completed and a RETURN occurs. If a flame is still indicated, the control unit checks the 5 second timer in step 414. If the 5 second timer is unexpired, the control unit loops back to execute step 408. After the 5 second timer has expired, the control unit proceeds directly to execute step 416 which activates the LED to flash continuously. When the flame persists for more than the 5 second timer, the LED flashing warning is thus activated and the usual pattern of operation is interrupted by the control unit beginning to execute the STAT RECOVER step of the INTERNAL LOCKOUT routine.

MOTOR FAULT

Figure 5:
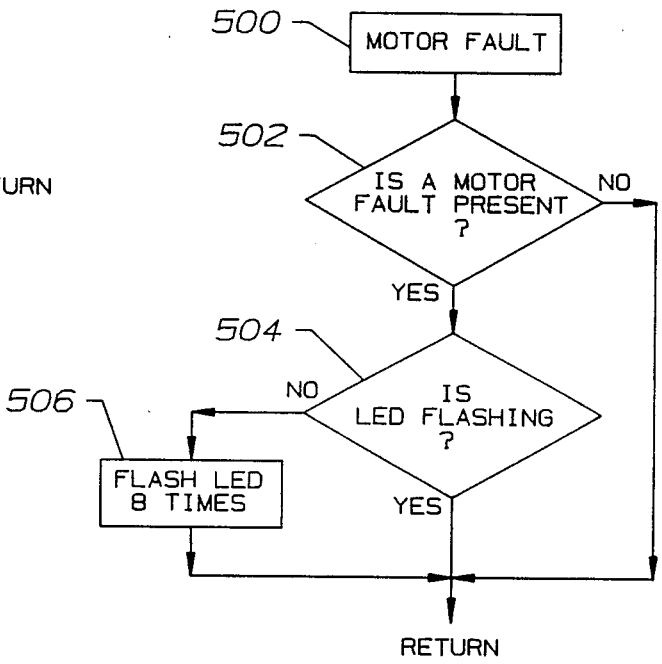
FIG. 5 is a flow chart of the MOTOR FAULT routine.

Another fault condition routine which checks on the circulator fan is MOTOR FAULT routine 500 of FIG. 5. First, the control unit checks for the presence of a fault signal from the circulator motor. The control unit RETURNs if no motor fault is present, but if a motor fault signal is present then the LED is examined to see if it is flashing in step 504. If the LED is flashing, a RETURN occurs, and if not the LED is flashed 8 times before a RETURN occurs.

ROLLOUT

Figure 6:
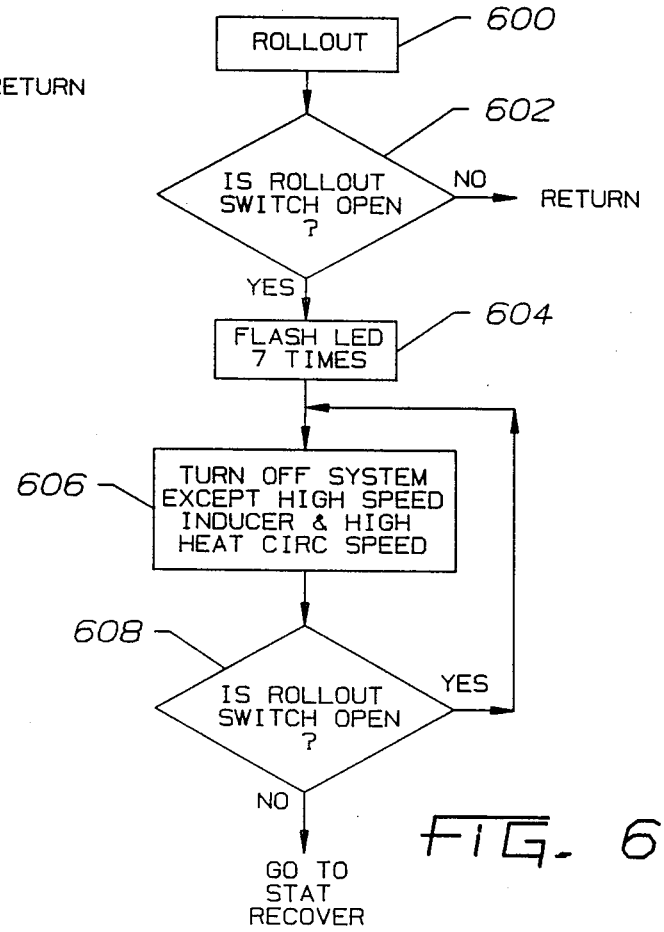
FIG. 6 is a flow chart of the ROLLOUT routine.

Another fault condition routine determines if a flame exists at positions away from the gas burners in the furnace, which is ROLLOUT routine 600 of FIG. 6. If the rollout switch is not open, then in step 602 a RETURN occurs, but an open rollout switch causes the control unit to execute step 604 which flashes the LED 7 times. Then in step 606, the control unit turns off every component except for the inducer fan which is turned on high and the circulator fan which is turned on high heat speed. After step 606, the control unit checks the rollout switch again checked in step 608. If the rollout switch remains open, then the control unit again attempts to close the rollout switch by executing step 606. However, if the rollout switch has been closed then the usual pattern of operation is interrupted by jumping to the STAT RECOVER step of the INTERNAL LOCKOUT routine.

INTERNAL LOCKOUT

Figure 7:
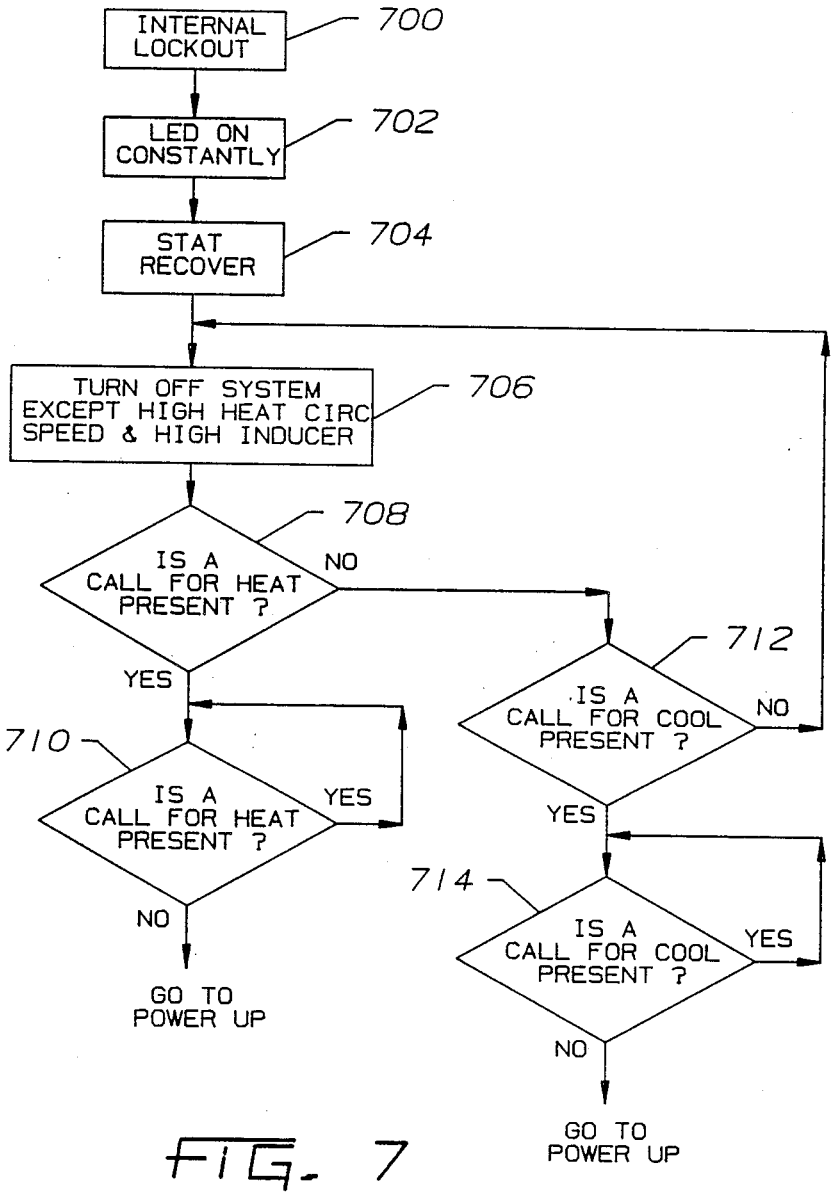
FIG. 7 is a flow chart of the INTERNAL LOCKOUT routine.

The flow-chart of the INTERNAL LOCKOUT routine 700 is shown in FIG. 7. Immediately after entering INTERNAL LOCKOUT 700, the LED is turned on constantly in step 702. STAT RECOVER is shown as the next step, 704, although no process step is necessarily represented by step 704. Rather, STAT RECOVER represents an entry point from many other routines which allows the control unit to continue operation during and after a fault condition occurs without having to shut down completely. The control unit executes INTERNAL LOCKOUT 700 until a manual reset at the thermostat of at least one second occurs, in which case the control unit begins to execute the POWER UP step of the main operating loop. A manual reset involves setting the desired temperature of the thermostat to a level which is satisfied by the indoor temperature, then resetting the thermostat to the actual desired temperature.

Next the control unit turns off all system components, except for the inducer fan which is turned on high speed and the circulator fan which is turned on high heat speed, in step 706. The control unit checks for the presence of a call for heat in step 708. If a call for heat is present, the control unit executes step 710. Step 710 has a loop structure which includes checking for a call for heat, looping when a call for heat exists, and going to POWER UP when no call for heat exists. If no call for heat is present in step 708, step 712 is performed which checks for the presence of a call for cool. If no call for cool exists, then execution goes back to STAT RECOVER 704, else step 714 is executed. Step 714 has a loop structure which includes checking for a call for cool, looping when a call for cool exists, and going to POWER UP when no call for cool exists.

THE HEATING CYCLE

Figure 8:
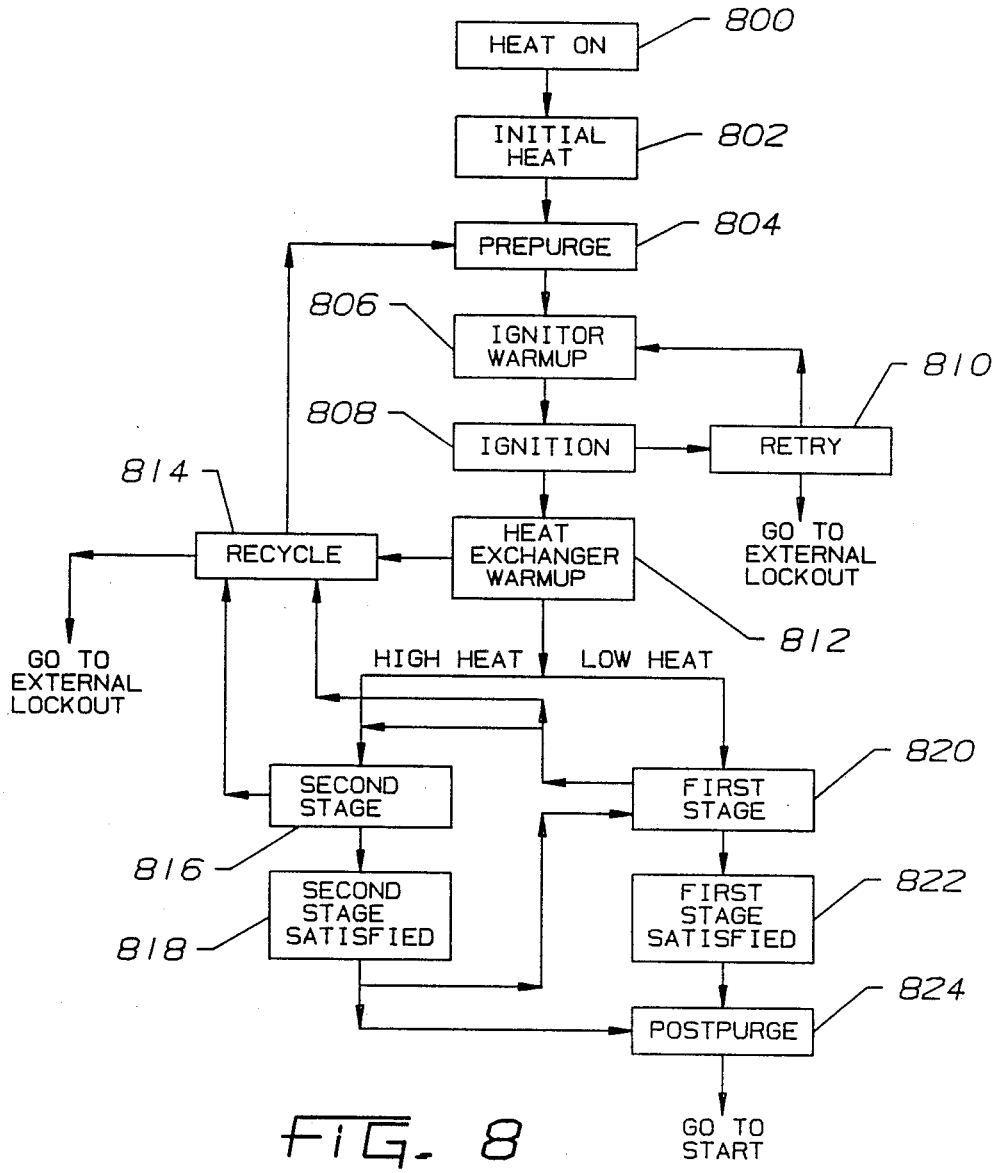
FIG. 8 is a flow chart of the operation of HEAT ON cycle.
Figure 9:
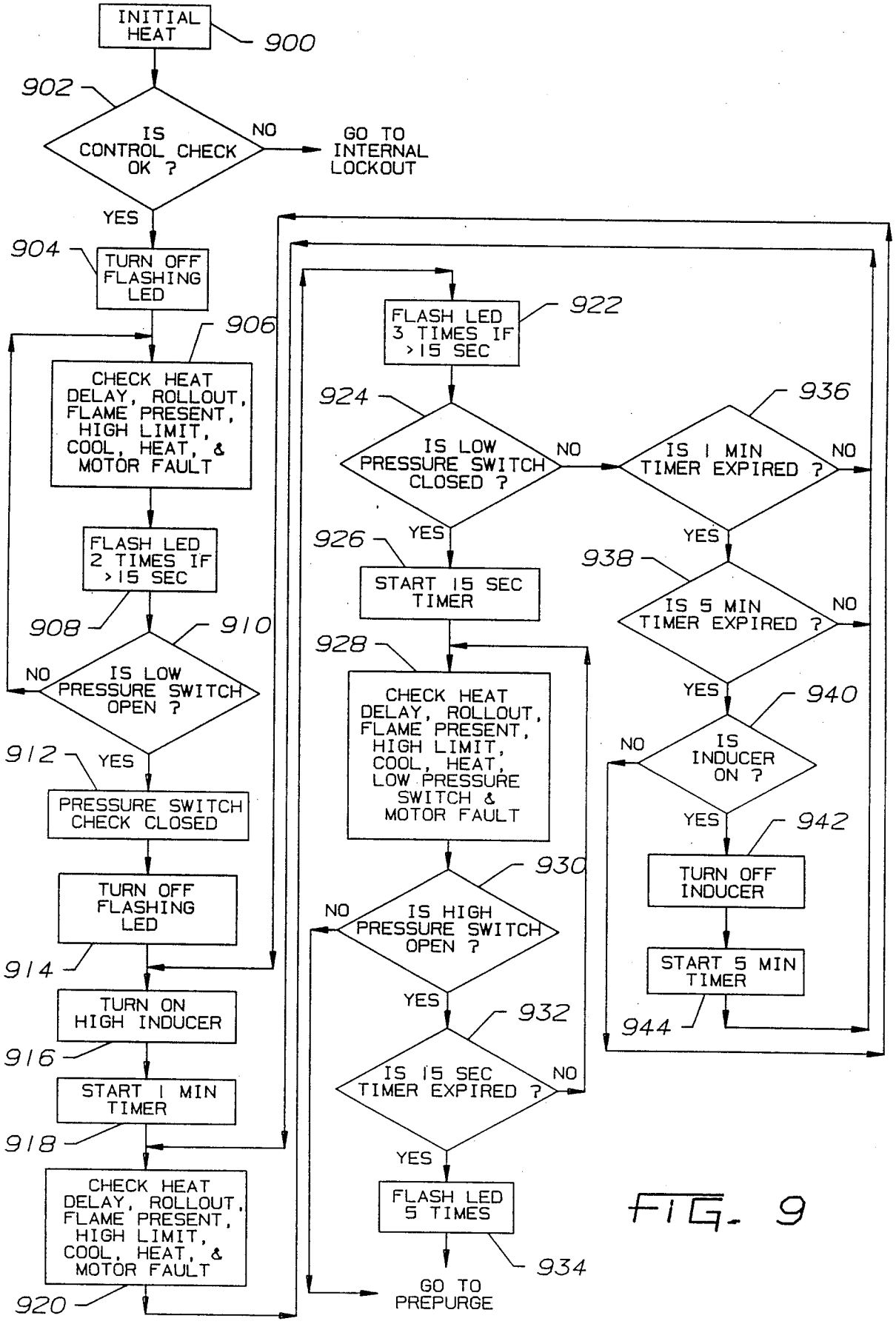
FIG. 9 is a flow chart of the INITIAL HEAT portion of the heating cycle.

A general flow chart of the heating cycle starts at HEAT ON 800 of FIG. 8. First the inducer fan and low pressure switch are tested to determine if heating can be started in INITIAL HEAT step 802. Next, the combustion chamber may be cleared out in optional PREPURGE step 804. IGNITOR WARMUP step 806 follows wherein the combustion chamber and hot surface ignitor is prepared for IGNITION step 808. If the ignitor cannot start a flame in step 808, RETRY step 810 involves the control unit determining whether to attempt to start a flame by executing IGNITOR WARMUP 806 or to halt system operation by executing EXTERNAL LOCKOUT (which is described below). After a successful ignition, HEAT EXCHANGER WARMUP step 812 prepares the furnace for providing heat. If the flame cannot be maintained in step 812, RECYCLE step 814 involves the control unit determining whether to attempt to restart the gas burners by executing PREPURGE step 804 o to halt system operation by executing EXTERNAL LOCKOUT. After HEAT EXCHANGER WARMUP step 812 has been successfully completed, the furnace begins either first stage or second stage heating according to the call for heat. A call for high heat will activate the second stage, and a call for low heat will activate the first stage.

In SECOND STAGE step 816, the furnace provides the second stage of heat. If the flame goes out during SECOND STAGE step 816 then the control unit execute RECYCLE step 814. When the call for high heat no longer exists, then operation proceeds to SECOND STAGE SATISFIED step 818. Frequently, after completing SECOND STAGE SATISFIED step 818 a call for low heat exists so then FIRST STAGE step 820 occurs. However, the second stage may have totally satisfied the heat demand of the building which would cause POSTPURGE step 824 to occur. Assuming a call for low heat exists at the end of step 812 or 818, then in FIRST STAGE step 820 the first stage of heat is supplied. If a call for high heat appears during FIRST STAGE step 820, then operation continues at SECOND STAGE step 816. If the flame goes out during SECOND STAGE step 816 or FIRST STAGE step 820 then the control unit executes RECYCLE step 814. When a call for heat no longer exists during FIRST STAGE step 820, then operation proceeds to FIRST STAGE SATISFIED step 822. Finally, optional POSTPURGE step 824 involves clearing out the combustion chamber before returning to START in the main operating loop.

INITIAL HEAT

INITIAL HEAT routine 900 starts with a control check in step 902 which causes the control unit to execute the INTERNAL LOCKOUT routine in the case of a failure. Otherwise, the flashing LED is turned off in step 904. Then at step 906 the control unit checks the HEAT DELAY (described below), ROLLOUT, FLAME PRESENT, HIGH LIMIT (described below), COOL (described below), HEAT (described below), and MOTOR FAULT routines. When the checks are completed, the control unit flashes the LED 2 times in step 908 if it determines that more than 15 seconds have transpired since step 904. The control unit then determines if the low pressure switch is open in step 910, and loops back to execute step 906 if it is not open.

Once the low pressure switch is open, the control unit tests to determine if the low pressure switch can close in PRESSURE SWITCH CHECK CLOSED step 912. First, the control unit turns off the flashing LED in step 914. Next in step 916, the control unit turns the inducer fan on high. Following in step 918, the control unit starts a one minute timer to begin a check of the low pressure switch. Then at step 920 the control unit performs checks for HEAT DELAY, ROLLOUT, FLAME PRESENT, HIGH LIMIT, COOL, HEAT, and MOTOR FAULT routines. When the checks are completed, the control unit flashes the LED 3 times in step 922 if more than 15 seconds have transpired since step 918.

If the low pressure switch is closed in step 924 then the control unit initiates the testing of the high pressure switch in step 926 by starting a 15 second timer. Next, the control unit checks the HEAT DELAY, ROLLOUT, FLAME PRESENT, HIGH LIMIT, COOL, HEAT, LOW PRESSURE SWITCH, and MOTOR FAULT routines in step 928. When the checks are completed, the control unit checks the state of the high pressure switch in step 930. A closed high pressure switch causes the operation to proceed to PREPURGE. If the high pressure switch is open then step 932 is executed which determines if the 15 second timer has expired. If time remains on the timer, then the operation loops back to execute step 928. However, if the 15 second timer has expired then the control unit flashes the LED 5 times in step 934 and begins to execute the PREPURGE portion of the heating cycle.

If the low pressure switch was open in step 924, the control unit allows the inducer fan additional time to close the low pressure switch. First, the control unit checks the one minute timer in step 936, and if unexpired the control unit loops back to execute step 920. However, if the one minute is insufficient to close the low pressure switch, a five minute rest is provided by the control unit. First, the five minute timer is tested in step 938. If the five minute timer is unexpired, the control unit loops back to execute step 920. If the five minute timer is expired, the control unit checks the inducer fan in step 940, which loops back to step 916 if the inducer fan is not on. If the inducer is on, then the control unit turns off the inducer fan in step 942 and starts the five minute timer in step 944. After starting the five minute timer, the control unit loops to execute step 920. Thus, the inducer fan runs for one minute on high to attempt to close the low pressure switch, then rests for five minutes before turning on high and again trying to closed the low pressure switch.

During the INITIAL HEAT portion of HEAT ON, the control unit executes a number of fault condition routines which check on any circulator delay times currently running (in HEAT DELAY), the state of environmentally responsive switches (in HIGH LIMIT and LOW PRESSURE SWITCH), and the thermostat status (in HEAT CHECK and COOL CHECK). Each of these routines is relatively short for quickly determining the information desired and appropriately responding to an indicated fault condition.

HEAT DELAY

Figure 10:
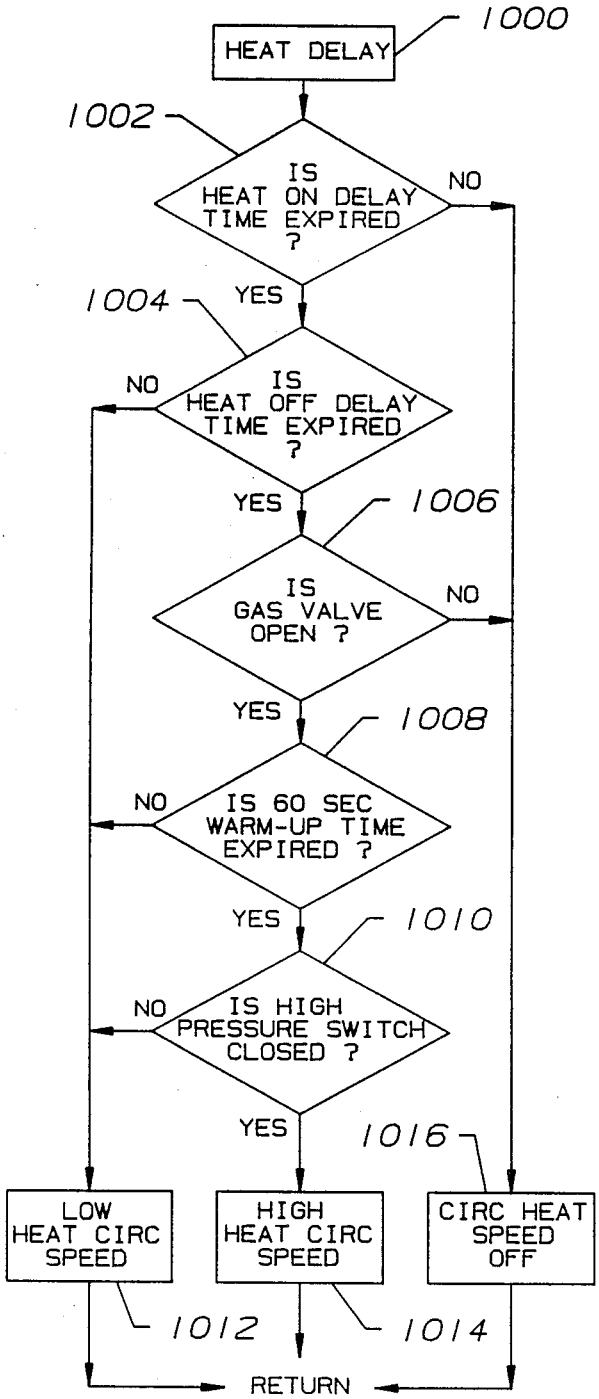
FIG. 10 is a flow chart of the HEAT DELAY routine.

The HEAT DELAY 1000 routine, shown in FIG. 10, sets the speed of the circulator fan according to the current position in the heat cycle and any on or off delays used. First in step 1002, the control unit determines if an unexpired heat on delay exists. When a heat on delay exists then the control unit turns off circulator fan speed in step 1016. Otherwise, the control unit determines if an unexpired heat off delay exists in step 1004, and if so the circulator fan speed is set to low heat speed in step 1012. When neither the heat on or off delay timers are running, the control unit determines if the gas valve is open in step 1006. When the gas valve is not open, the circulator fan heat speed is turned off in step 1016. If the gas valve is open, the control unit checks if a 60 second warmup timer has expired, in effect determining if the control unit is executing the heat exchanger warmup portion of the heating cycle. If the 60 second warmup timer is running but has not expired, then in step 1012 the control unit sets the circulator fan to low heat speed. Finally in step 1010, the control unit determines whether the high pressure switch is closed, activating the high heat speed of the circulator fan in step 1014 when closed and activating the low heat speed of the circulator fan in step 1012 otherwise. After executing either of steps 1012, 1014, or 1016, a RETURN occurs.

HIGH LIMIT

Figure 11:
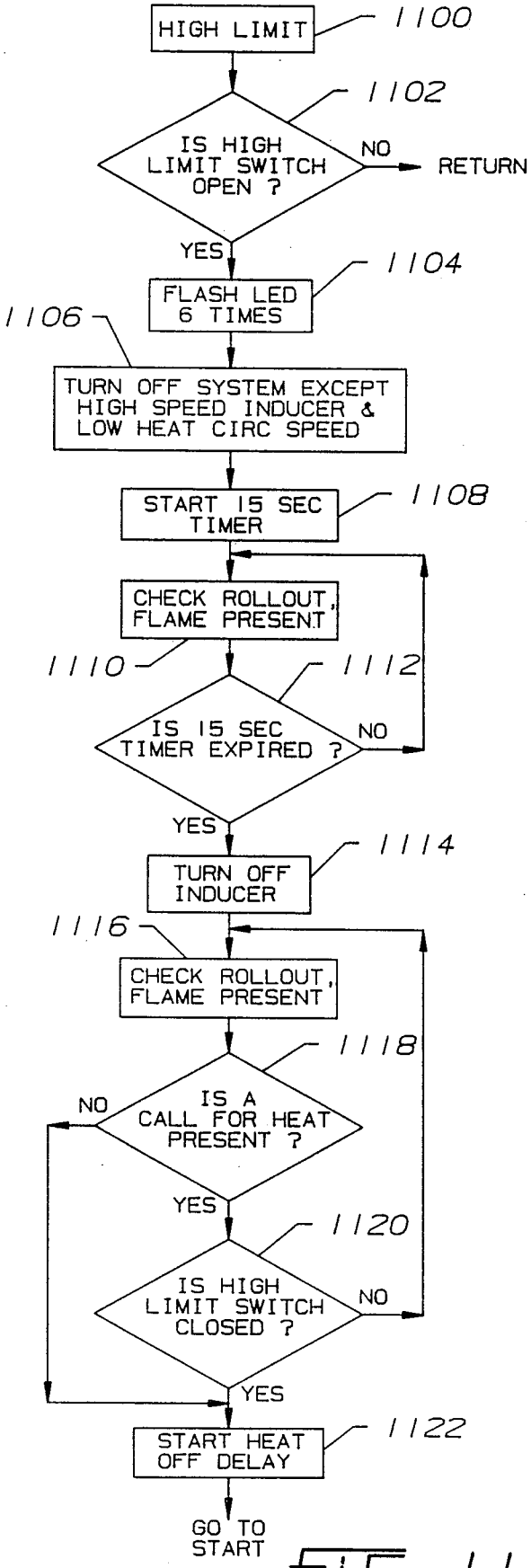
FIG. 11 is a flow chart of the HIGH LIMIT routine.

The HIGH LIMIT 1100 routine of FIG. 11 checks the high limit temperature switch in the furnace and attempts to cure any problem indicated by an open high limit switch. First, the control unit determines if the high limit switch is open in step 1102. If the high limit switch is not open then a RETURN occurs. However, if the temperature in the furnace has risen sufficiently, the high limit switch opens. In this case, the control unit sets the LED to flash 6 times in step 1104, followed by turning off all system components in step 1106, except for setting the inducer on high and the circulator fan on low heat speed. Then, the control unit starts a 15 second timer in step 1108. In step 1110, the control unit performs checks for Rollout and Flame Present. The control unit checks the 15 second timer in step 1112, and if time has not yet expired the control unit loops back to execute step 1110.

After the expiration of the 15 second timer, the control unit turns off the inducer in step 1114. The control unit performs checks for Rollout and Flame Present in step 1116, followed by checking for a call for heat in step 1118. If a call for heat exists, the control unit checks the high limit switch in step 1120, and if the high limit is still open then the control unit loops to execute step 1116. When either no call for heat is present or the high limit switch recloses during a call for heat, the control unit starts a heat off delay in step 1122 and then begins to execute at START in the main operating loop.

COOL CHECK

Figure 12:
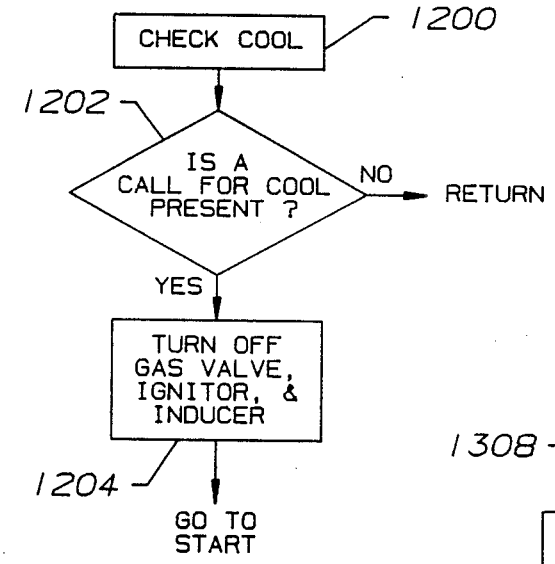
FIG. 12 is a flow chart of the COOL CHECK routine.

COOL CHECK routine 1200 of FIG. 12 determines if a call for cool is present, and when a call for cool exists the control unit executes the main operating loop. In step 1202, the control unit determines if a call for cool from the thermostat is present. If no call for cool is present, a RETURN occurs. However, if a call for cool exists then the gas valve, ignitor, and inducer are turned off in step 1204 and the control unit begins to execute at START in the main operating loop.

HEAT CHECK

Figure 13:
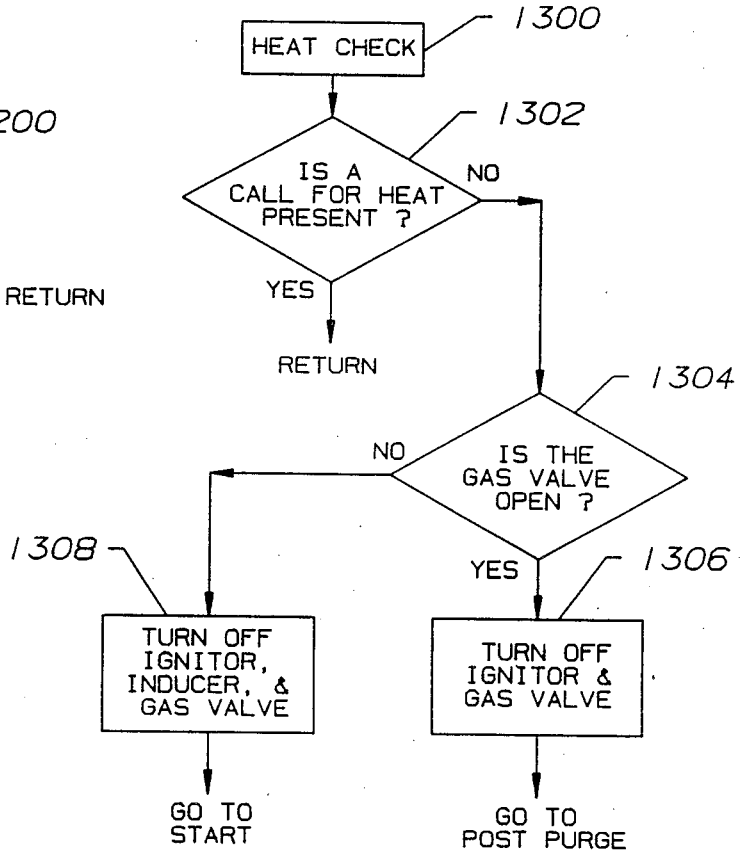
FIG. 13 is a flow chart of the HEAT CHECK routine.

Similar to COOL CHECK, HEAT CHECK 1300 of FIG. 13 determines if a call for heat is present, and when a call for heat no longer exists the control unit executes the main operating loop. In step 1302, the control unit determines if a call for heat from the thermostat is present. If a call for heat is present, a RETURN occurs. However, if a call for heat no longer exists then the control unit determines if the gas valve is open in step 1304. If the gas valve is open, then the control unit turns off the ignitor and gas valve and begins to execute the POSTPURGE portion of the main operating loop. If the gas valve is not open, then the control unit turns off the ignitor, inducer fan, and gas valve and begins to execute at START in the main operating loop.

LOW PRESSURE SWITCH

Figure 14:
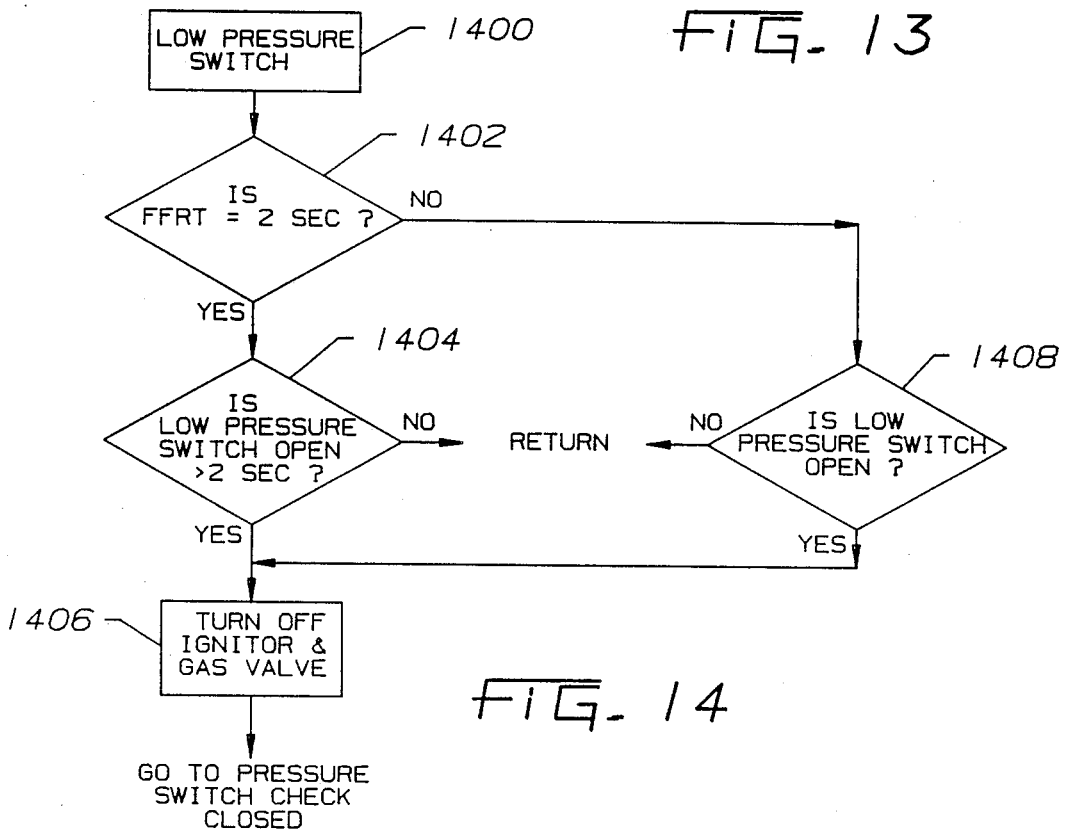
FIG. 14 is a flow chart of the LOW PRESSURE SWITCH routine.

The test of LOW PRESSURE SWITCH 1400 routine in FIG. 14 determines if the low pressure switch has been closed for an amount of time determined by the current flame failure response time (FFRT) setting. In step 1402, the control unit compares the flame failure response time to the value of 2 seconds. If the FFRT equals 2 seconds, then the control unit determines if the low pressure switch has been open for greater than 2 seconds in step 1402. If open for greater than 2 seconds, the control unit turns off the ignitor and gas valve in step 1406 and begins to execute at the PRESSURE SWITCH CHECK CLOSED step in the INITIAL HEAT portion of the heating cycle, otherwise a RETURN occurs. If the FFRT is not equal to 2 seconds, then the control unit determines if the low pressure switch is currently open in step 1408. If open then the control unit executes step 1406 and proceeds to execute PRESSURE SWITCH CHECK CLOSED of the INITIAL HEAT portion of the heating cycle.

PREPURGE

Figure 15:
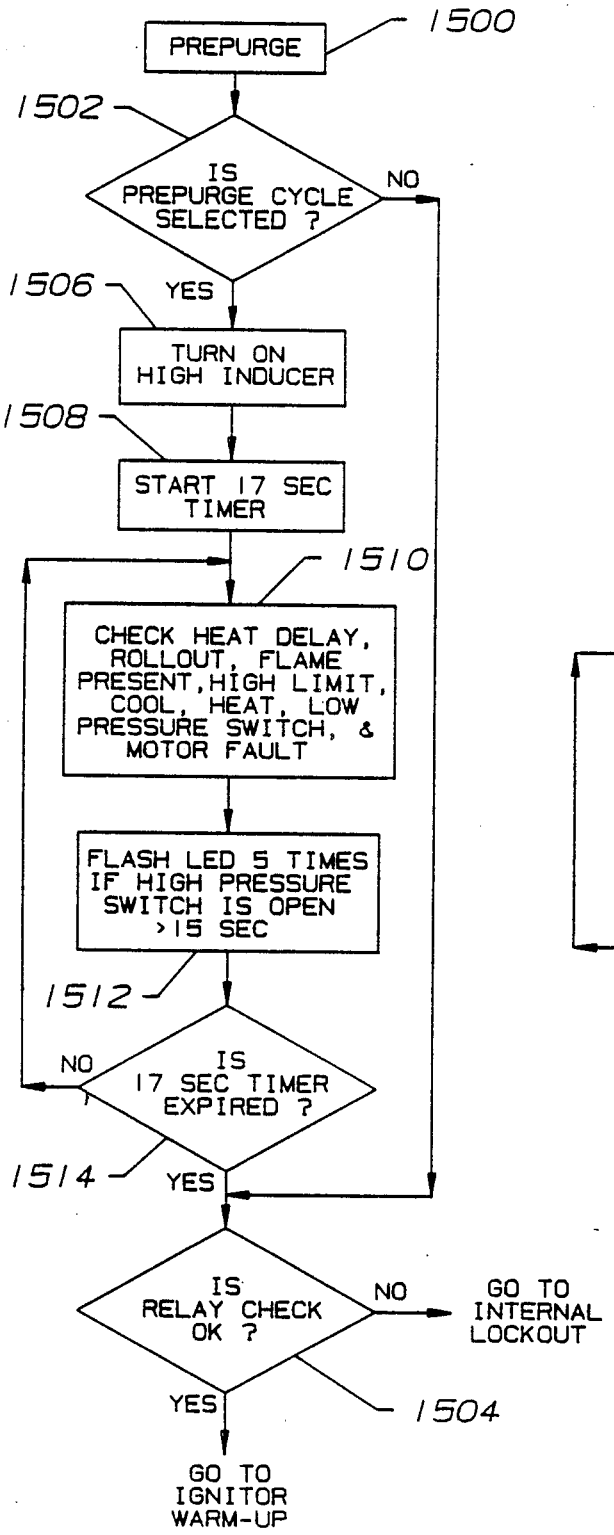
FIG. 15 is a flow chart of the PREPURGE portion of the heating cycle.

Upon completion of the INITIAL HEAT portion of the heating cycle, PREPURGE 1500 portion shown in FIG. 15 is for clearing out the combustion chamber of the furnace. First, the control unit determines if a prepurge cycle has been selected in step 1502. The preset selection of prepurge or no prepurge can be accomplished similarly to how heat or cool on/off delays are selected. If prepurge is not selected, then the control unit executes a relay check in step 1504 which determines if the relay or relays of the control unit are welded closed. If the relays are welded shut, the control unit begins to execute the INTERNAL LOCKOUT routine. Assuming normal functioning of the relays, the control unit begins to execute the IGNITOR WARMUP portion of the heating cycle.

If prepurge is selected in step 1502 then in step 1506 the control unit turns the inducer fan on high, and then starts a 17 second timer in step 1508. During the 17 seconds, the inducer fan operates at high speed to maximize the amount purged. Next, the control unit executes checks for HEAT DELAY, ROLLOUT, FLAME PRESENT, HIGH LIMIT, COOL, HEAT, LOW PRESSURE SWITCH, and MOTOR FAULT in step 1510. The LED is set to flash five times in step 1512 if the high pressure switch is open after more than 15 seconds. The control unit tests the 17 second timer in step 1514, looping back to execute step 1510 until the 17 seconds have expired. After expiration of the 17 second timer, the control unit executes step 1504 for the relay check and prospectively to execute the IGNITOR WARMUP portion.

IGNITOR WARMUP

Figure 16:
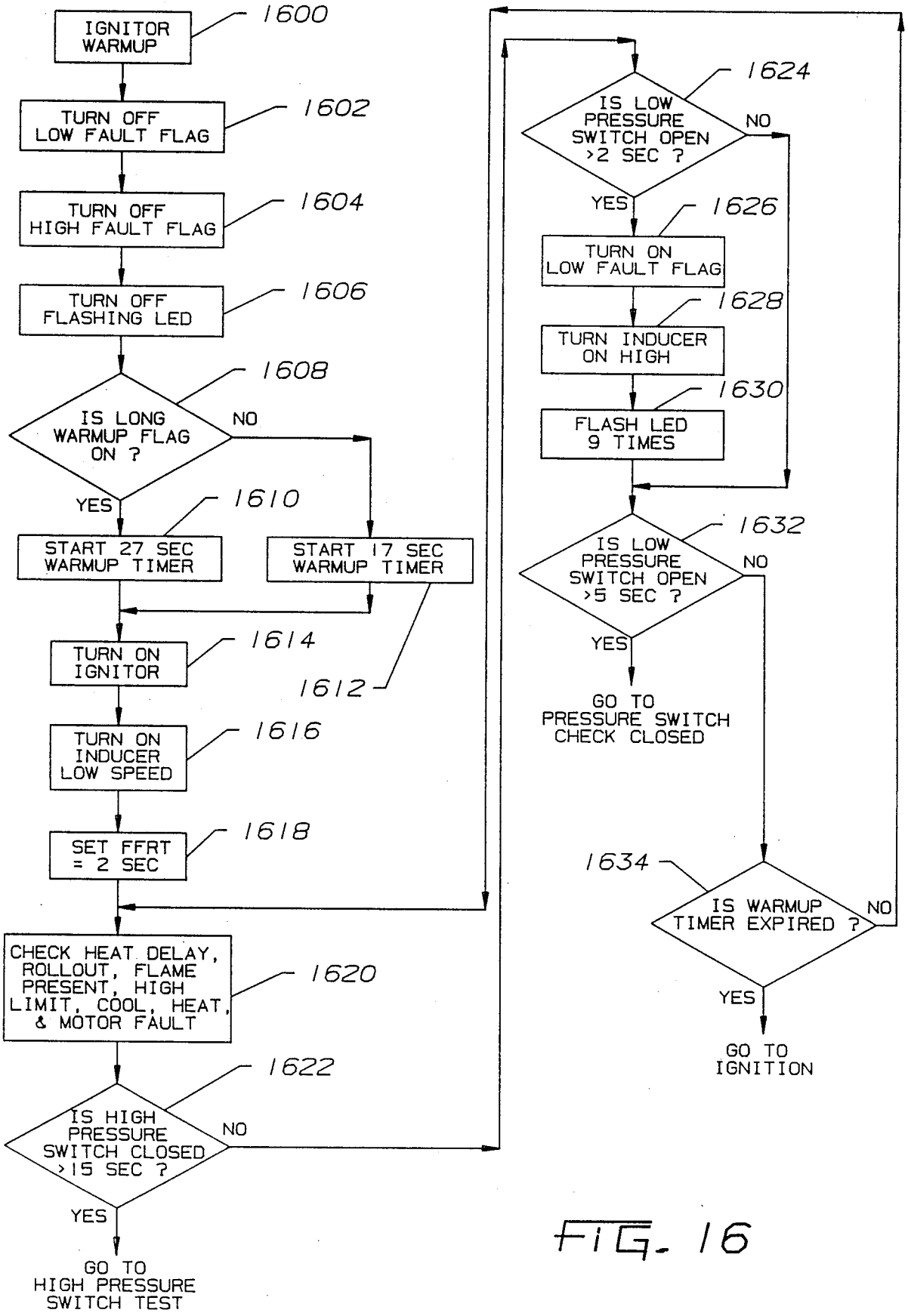
FIG. 16 is a flow chart of the IGNITOR WARMUP portion of the heating cycle.

After clearing the combustion chamber in PREPURGE, the ignitor is prepared to start the flame in IGNITOR WARMUP 1600 portion of FIG. 16. The control unit turns off the low fault flag in step 1602, turns off the high fault flag in step 1604, and turns off the flashing LED in step 1606. Then in step 1608 the control unit determines if the long warmup flag is on. If on, the control unit starts a 27 second warmup timer in step 1610, and if off the control unit starts a 17 second warmup timer in step 1612. In either case, the control unit then turns on the ignitor in step 1614 turns on the low speed of the inducer in step 1616, and sets the FFRT equal to 2 seconds in step 1618. Next, the control unit performs checks for HEAT DELAY, ROLLOUT, FLAME PRESENT, HIGH LIMIT, COOL, HEAT, and MOTOR FAULT in step 1620. Following step 1620, the control unit determines if the high pressure switch has been closed for over 15 seconds in step 1622. If the high pressure switch has been closed over 15 seconds, the control unit begins to execute the HIGH PRESSURE SWITCH TEST routine, described below, in attempt to cure this undesired condition.

Assuming a negative result to the determination of step 1622, the control unit then determines if the low pressure switch has been open for greater than 2 seconds. If the low pressure switch has been open more than 2 seconds, the control unit turns on the low fault flag in step 1626, turns on the high speed of the inducer fan in step 1628, and sets the LED to flash 9 times in step 1630. After step 1630 or after a negative result to the test of step 1624, the control unit determines if the low pressure switch has been open for more than 5 seconds in step 1632. If the low pressure switch has been open for 5 seconds, the control unit begins to execute at the PRESSURE SWITCH CHECK CLOSED step of the INITIAL HEAT portion. Assuming a negative result to the test of step 1632, the control unit determines if the warmup timer has expired in step 1634. If expired, the control unit begins to execute the IGNITION portion of the heating cycle, and if unexpired the control unit loops back to execute step 1620.

HIGH PRESSURE SWITCH CHECK

Figure 17:
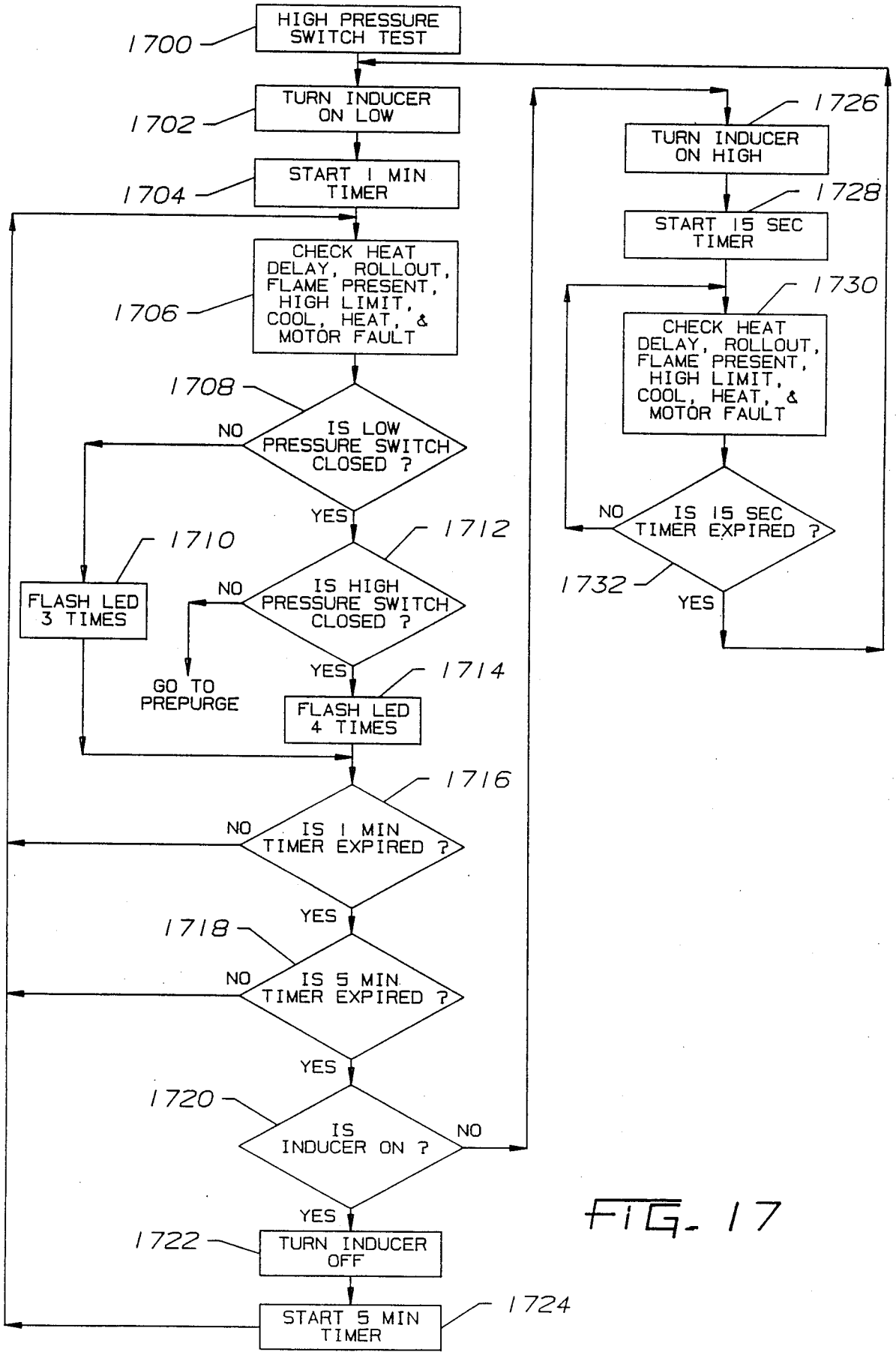
FIG. 17 is a flow chart of the HIGH PRESSURE SWITCH TEST routine.

In the event that the high pressure switch is closed for a significant time while the inducer fan operates at a low speed, HIGH PRESSURE SWITCH CHECK 1700 routine of FIG. 17 can be executed to attempt to open the high pressure switch. First, the control unit turns on the low speed of the inducer in step 1702, and starts a 1 minute timer in step 1704. Then, the control unit performs checks for HEAT DELAY, ROLLOUT, FLAME PRESENT, HIGH LIMIT, COOL, HEAT, and MOTOR FAULT in step 1706. Next, the control unit determines if the low pressure switch is closed in step 1708. If the low pressure switch is not closed then the control unit sets the LED to flash 3 times in step 1710 and proceeds to execute step 1716. If the low pressure switch is closed, the control unit determines if the high pressure switch is closed in step 1712. When the high pressure switch is not closed, the control unit begins to execute the PREPURGE portion of the heating cycle. However, if the high pressure switch is closed then the control unit sets the LED to flash 4 times before executing step 1716.

After determining a problem still exists with the pressure switches, i.e., the inducer fan operates at low speed and either the low pressure switch is open or the high pressure switch is closed, the control unit determines if the 1 minute timer has expired in step 1716. If unexpired, the control unit loops back to execute step 1706. If expired, the control unit determines if the 5 minute timer has run and expired in step 1718. If the 5 minute timer is running and unexpired, the control unit loops back to execute step 1706. However, if the 5 minute timer has not run or has run and expired, the control unit determines if the inducer fan is on in step 1720. If the inducer fan is on then the control unit turns off the inducer fan in step 1722, starts the 5 minute timer in step 1724, and loops back to execute step 1706.

When the inducer fan is on in step 1720, the control unit turns on the high speed of the inducer fan in step 1726. Next, the control unit starts a 15 second timer in step 1728, then performs checks for HEAT DELAY, ROLLOUT, FLAME PRESENT, HIGH LIMIT, COOL, HEAT, and MOTOR FAULT in step 1730. The control unit determines if the 15 second timer has expired in step 1732. If expired, the control unit loops back to execute step 1702, and if unexpired the control unit loops back to execute step 1730. Thus, HIGH PRESSURE SWITCH TEST 1700 attempts to cure a pressure switch problem by running the inducer fan on low speed for 1 minute, turning off the inducer fan for 4 minutes, and running the inducer fan on high speed for 15 seconds before starting another cycle. The control unit periodically checks for an open high pressure switch during the cycle of FIG. 17 when the inducer fan is not running on high speed.

IGNITION

Figure 18:
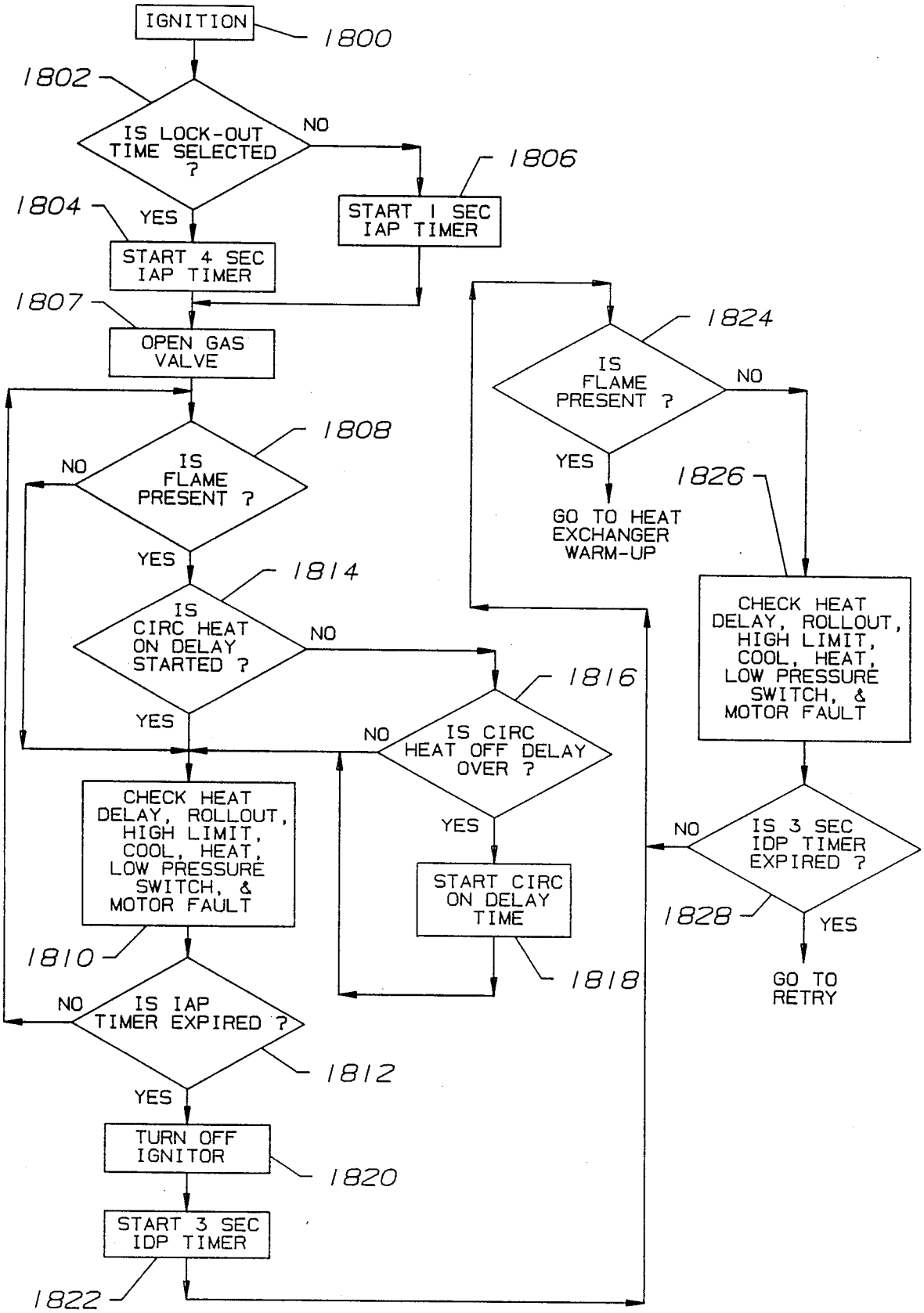
FIG. 18 is a flow chart of the IGNITION portion of the heating cycle.

After activating the ignitor and determining the pressure switches are operating properly, the control unit begins the IGNITION 1800 portion of the heating cycle a shown in FIG. 18. First, the control unit determines if the optional lockout time has been selected in step 1802. Lockout time, which is the maximum amount of time devoted to an attempted ignition before retrying, equals the sum of the ignition activation period (IAP) and ignition deactivation period (IDP), with the optional value being 7 seconds (4 sec IAP and 3 sec IDP) and the standard value being 4 seconds (1 sec IAP and 3 sec IDP). The optional lockout time can be selected in a manner similar to selecting the heat and cool on/off delays. So if the optional lockout time is selected, in step 1804 the control unit starts a 4 second IAP timer. When the option has not been selected, the control unit starts a 1 second timer in step 1806. In either case, the control unit opens the gas valve in step 1807.

With the gas valve open and the ignitor activated from IGNITOR WARMUP, the control unit determines if a flame is present by directly checking the flame sensor in step 1808. If no flame is indicated, the control unit performs checks for HEAT DELAY, ROLLOUT, HIGH LIMIT, COOL, HEAT, LOW PRESSURE SWITCH, and MOTOR FAULT in step 1810. After the checks of step 1810, the control unit determines if the IAP timer has expired in step 1812. If unexpired, the control unit loops to execute step 1808.

If a flame is indicated during step 1808, the control unit determines if a circulation fan on delay has started. If an on delay has started, then the control unit executes step 1810. However, if on delay has not yet started the control unit determines if a circulation fan off delay is over. If the off delay is not over, then the control unit executes step 1810. If the off delay is over, the control unit starts the circulation fan on delay time in step 1818 before executing step 1810.

After the expiration of the IAP timer, the control unit turns off the ignitor in step 1820 and starts a 3 second IDP timer in step 1822. Following starting the IDP timer, the control unit directly checks the flame sensor in step 1824 and begins to execute the HEAT EXCHANGER WARMUP portion of the heating cycle if a flame is indicated. If no flame is indicated in step 1824, then the control unit performs checks on HEAT DELAY, ROLLOUT, HIGH LIMIT, COOL, HEAT, LOW PRESSURE SWITCH, and MOTOR FAULT in step 1826. Then in step 1828 the control unit determines if the IDP timer has expired. If unexpired, the control unit loops back to execute step 1824, but when the IDP timer expires the control unit begins to execute the RETRY portion of the heating cycle.

RETRY

Figure 19:
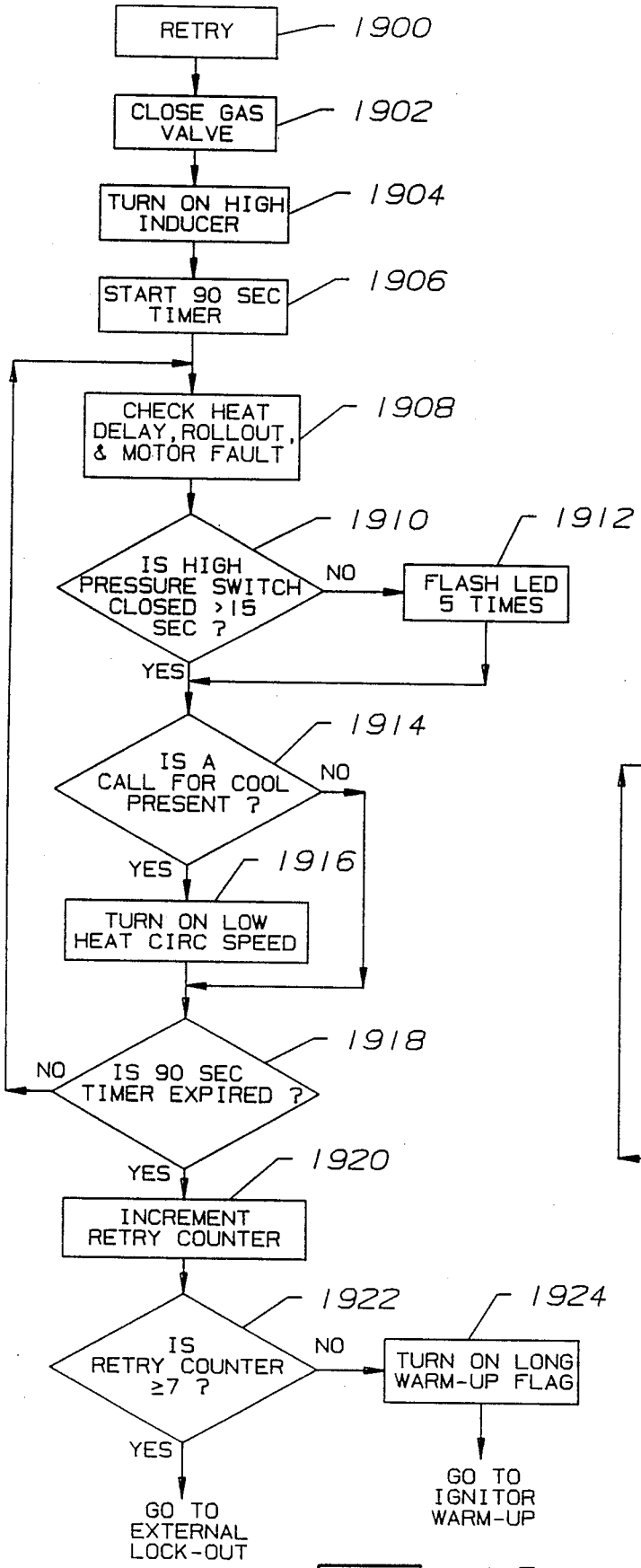
FIG. 19 is a flow chart of the RETRY portion of the heating cycle.

When a flame is not indicated during the IDP, the control unit executes RETRY 1900 portion shown in FIG. 19. RETRY 1900 is for providing multiple attempts to achieve a flame during the lockout time before an EXTERNAL LOCKOUT (described below) is necessary. The control unit begins by closing the gas valve in step 1902, turning on the high speed of the inducer fan in step 1904, and starting a 90 second timer in step 1906 for timing the purging of the combustion chamber.

The purging continues as the control unit performs checks for HEAT DELAY, ROLLOUT, and MOTOR FAULT in step 1908. Next, the control unit determines if the high pressure switch has been closed for greater than 15 seconds in step 1910, and if not then the control unit sets the LED to flash 5 times in step 1912. In either case, the control unit determines if a call for cool is present in step 1914, turning on the low heat speed of the circulator fan if a call for cool is present so air flows through the compressor coils in step 1916. In either case, the control unit determines if the 90 second timer expired in step 1918, and if unexpired the purging continues by the control unit looping to execute step 1908.

After the 90 second timer has expired, the control unit increments the retry counter in step 1920. Then the control unit compares the value of the RETRY counter to 7, and begins to execute the EXTERNAL LOCKOUT routine if the RETRY counter is greater than or equal to 7. However, if the RETRY counter is less than 7, the control unit turns on the long warmup flag in step 1924 and begins to execute the IGNITOR WARMUP portion of the heating cycle.

EXTERNAL LOCKOUT

Figure 20:
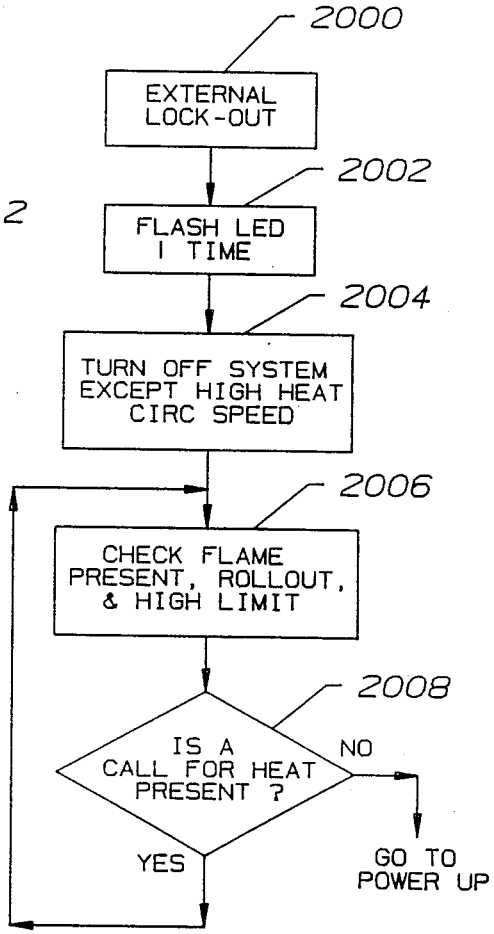
FIG. 20 is a flow chart of the EXTERNAL LOCKOUT routine.

When a failure of a system component outside the control unit occurs, the control unit executes the EXTERNAL LOCKOUT 2000 routine of FIG. 20. First, the control unit sets the LED to flash 1 time in step 2002 and then turns off all the system components except for turning on the high heat speed of the circulator fan in step 2004. Next, the control unit performs checks for FLAME PRESENT, ROLLOUT, and HIGH LIMIT in step 2006. After those three checks, the control unit checks for the presence of a call for heat in step 2008. If a call for heat is present, the control unit loops back to execute step 2006. When no call for heat exists, the control unit begins to execute the POWER UP step of the main operating loop.

HEAT EXCHANGER WARMUP

Figure 21A:
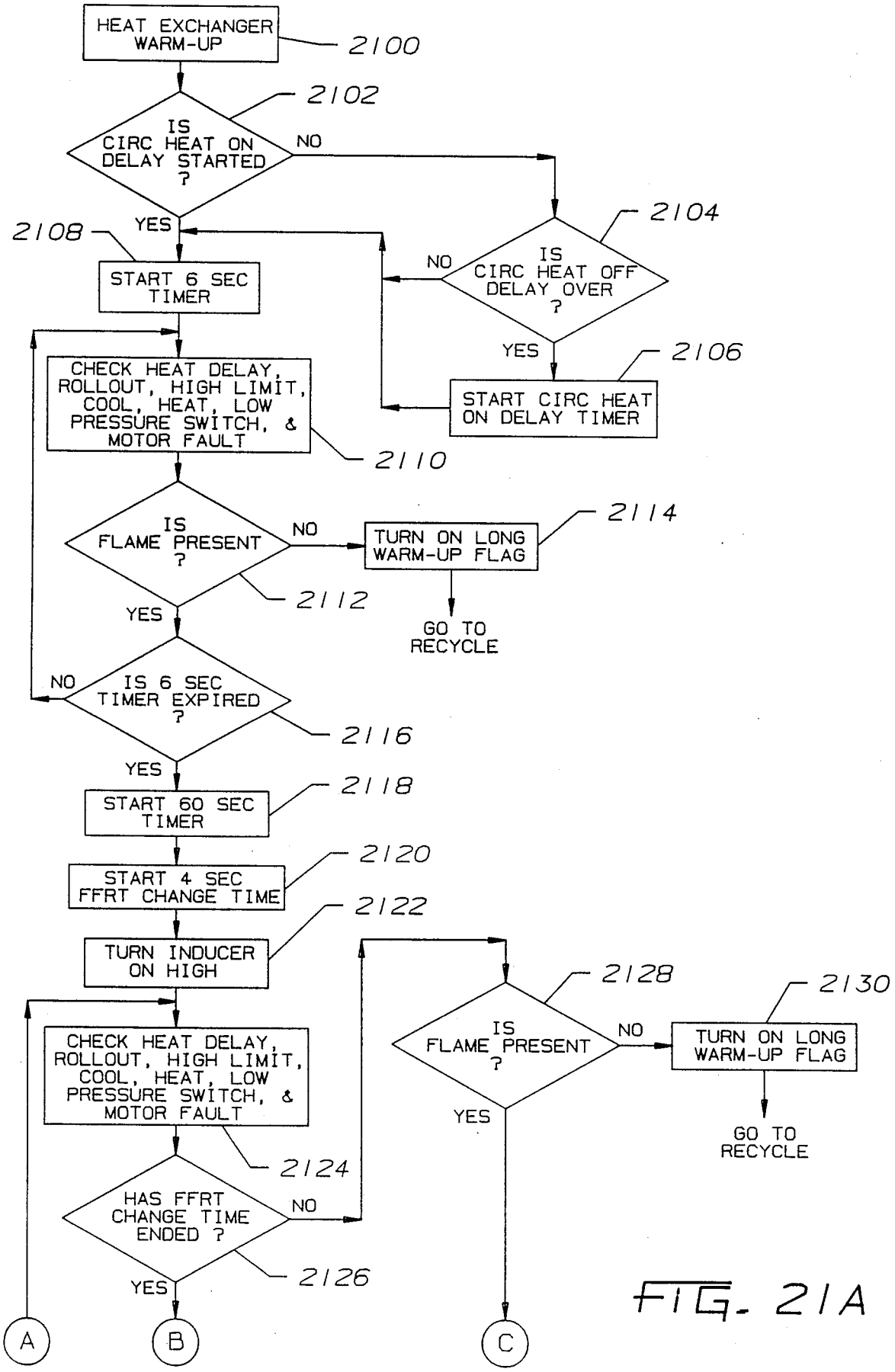
FIGS. 21A and 21B are flow charts of the HEAT EXCHANGER WARMUP portion of the heating cycle.
Figure 21B:
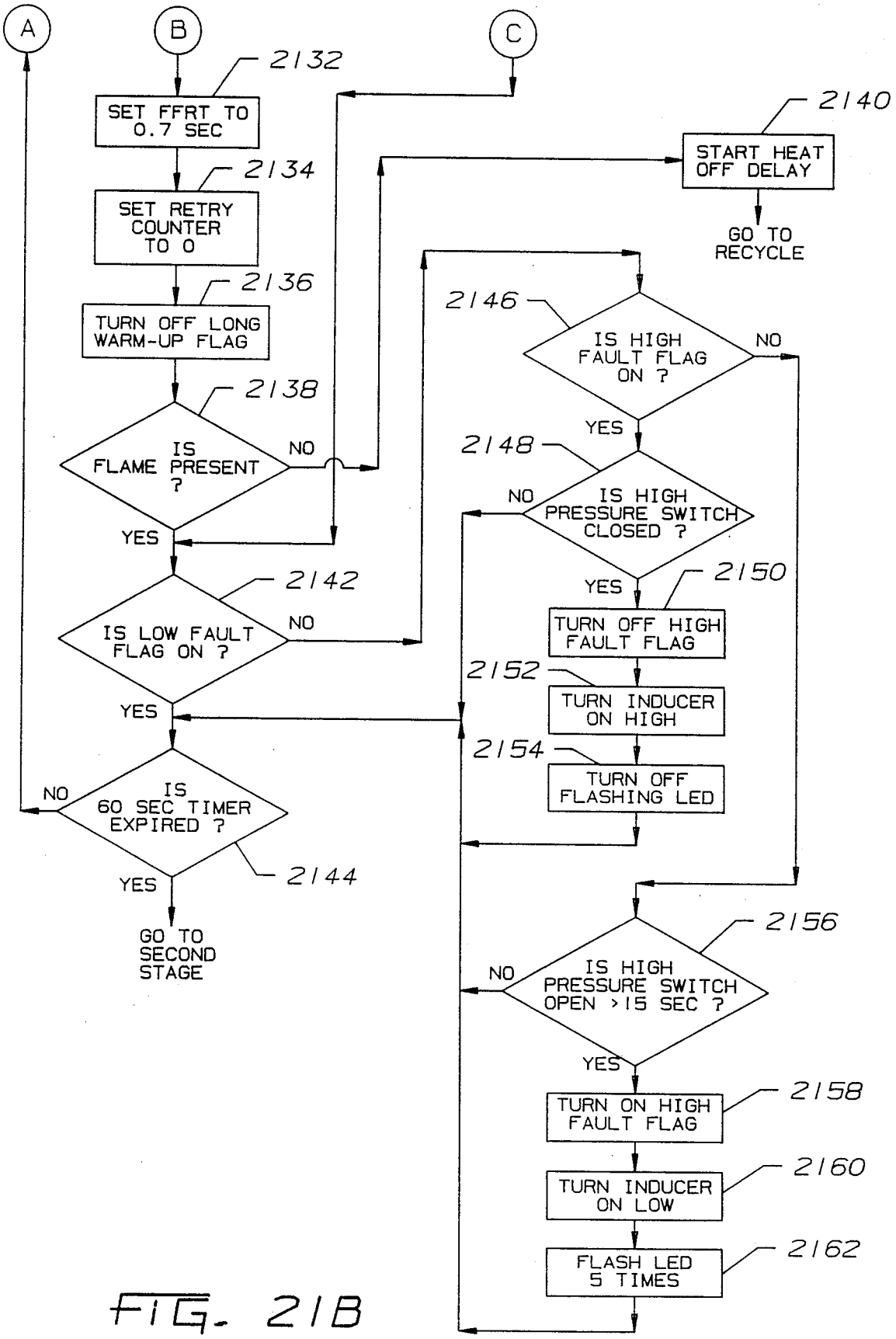

After the gas burner successfully lights in the IGNITION portion of the heating cycle, the gas burner heats the heat exchangers of the furnace to provide either first or second stage heat. In HEAT EXCHANGER WARMUP 2100 portion of the heating cycle of FIG. 21, the control unit has a flame lit period for determining that a flame has been established. After the flame lit period, the heat exchanger warmup period begins as the control unit attempts to activate the high setting of the gas valve and quickly heat the heat exchangers by running the inducer fan at high heat speed, while the circulator fan runs at low heat speed after a heat on delay. The heat on delay can be set at one of 15, 30, 45, and 60 second intervals which guarantees that the circulator fan will run at low speed before entering the second stage. In the exemplary embodiment, heat on delay is set to 30 seconds to allow the heat exchanger to properly warm up but not overshoot the desired outlet air temperature. Accounting for a lag time of 5 to 10 seconds for the circulator fan to ramp up to low heat speed, approximately 35 to 40 seconds after initiation of HEAT EXCHANGER WARMUP 2100 the circulator fan operates at the low heat speed setting. Also, if the flame is lost during HEAT EXCHANGER WARMUP 2100, the control unit executes a RECYCLE routine (described below) to attempt ignition again.

First during the flame lit period, the control unit determines if a heat on delay has started in step 2102, executing step 2108 if started. If not yet started, the control unit determines if a heat off delay is over in step 2104, starting the heat on delay timer in step 2106 if the heat on delay is over. In either event, the control unit then starts a 6 second timer in step 2108. Then, the control unit performs checks for HEAT DELAY, ROLLOUT, HIGH LIMIT, COOL, HEAT, LOW PRESSURE SWITCH, and MOTOR FAULT in step 2110. Next, the control unit directly determines if a flame is indicated by the flame sensor in step 2112, and if a flame is not indicated then the control unit turns on the long warmup flag in step 2114 and begins to execute the RECYCLE routine (hence an unsuccessful flame lit period). If a flame is indicated, then the control unit determines if the 6 second timer has expired in step 2116, looping back and executing step 2110 if unexpired.

If the flame lit period is successfully completed, then the heat exchanger warmup period starts by the control unit starting a 60 second timer in step 2118, starting a 4 second FFRT change time in step 2120, and turning the inducer fan on high speed in step 2122. Next, the control unit performs checks for HEAT DELAY, ROLLOUT, HIGH LIMIT, COOL, HEAT, LOW PRESSURE SWITCH, and MOTOR FAULT in step 2124. The control unit then determines if the FFRT change time has ended in step 2126. During FFRT change time, the control unit directly determines if the flame sensor indicates any flame in step 2128. If the flame sensor indicates that no flame exists, then the control unit turns on the long warm-up flag in step 2130 and begins to execute the RECYCLE routine. If the flame sensor indicates the presence of a flame, then the control unit executes step 2142 (described below).

Once FFRT change time has ended, the control unit sets FFRT to 0.7 seconds in step 2132, sets the RETRY counter to 0 in step 2134, and turns off the long warmup flag in step 2136. Then, the control unit directly determines if the flame sensor indicates that a flame is present in step 2138. If the flame sensor indicates that no flame exists, then the control unit starts a heat off delay in step 2140 and begins to execute the RECYCLE routine. When a flame exists, the control unit determines the state of the low fault flag in step 2142. If the low fault flag is on, then the control unit determines if the 60 second timer has expired in step 2144. If expired the control unit begins to execute the SECOND STAGE portion of the heating cycle, and if unexpired the control unit loops to execute step 2124.

If the low fault flag is not on in step 2142, the control unit determines if the high fault flag is on in step 2146. If the high fault flag is on, then the control unit directly determines if the high pressure switch is closed in step 2148, proceeding to step 2144 if not closed. If the high pressure switch is closed, then the control unit turns off the high fault flag in step 2150, turns on the high speed of the inducer fan in step 2152, and turns off the flashing LED in step 2154 before executing step 2144. If the high fault flag is not on in step 2146, the control unit determines if the high pressure switch has been open for greater than 15 seconds in step 2156, executing step 2144 if not. If the test of step 2156 is positive, then the control unit turns on the high fault flag in step 2158, turns on the low speed of the inducer fan in step 2160, and sets the LED to flash 5 times in step 2162 before executing step 2144.

RECYCLE

Figure 22:
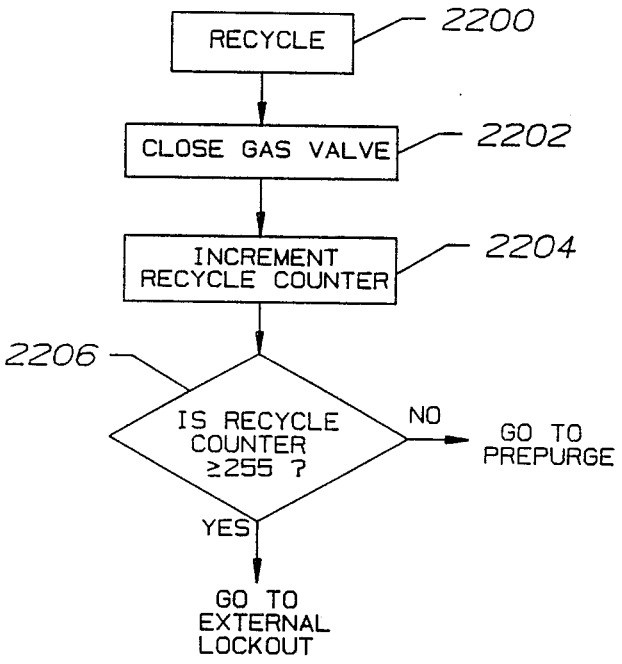
FIG. 22 is a flow chart of the RECYCLE portion of the heating cycle.

The RECYCLE 2200 routine of FIG. 22 allows up to 255 attempts to keep the flame lit throughout and after the HEAT EXCHANGER WARMUP portion of the heating cycle. First, the control unit closes the gas valve in step 2202 and increments the recycle counter by one in step 2204. In step 2206, the control unit determines if the value of the recycle counter is greater than or equal to 255. If the recycle counter is at least 255, then the control unit executes the EXTERNAL LOCKOUT routine. If the recycle counter is less than 255, the control unit proceeds to execute the PREPURGE portion of the heating cycle.

SECOND STAGE

Figure 23:
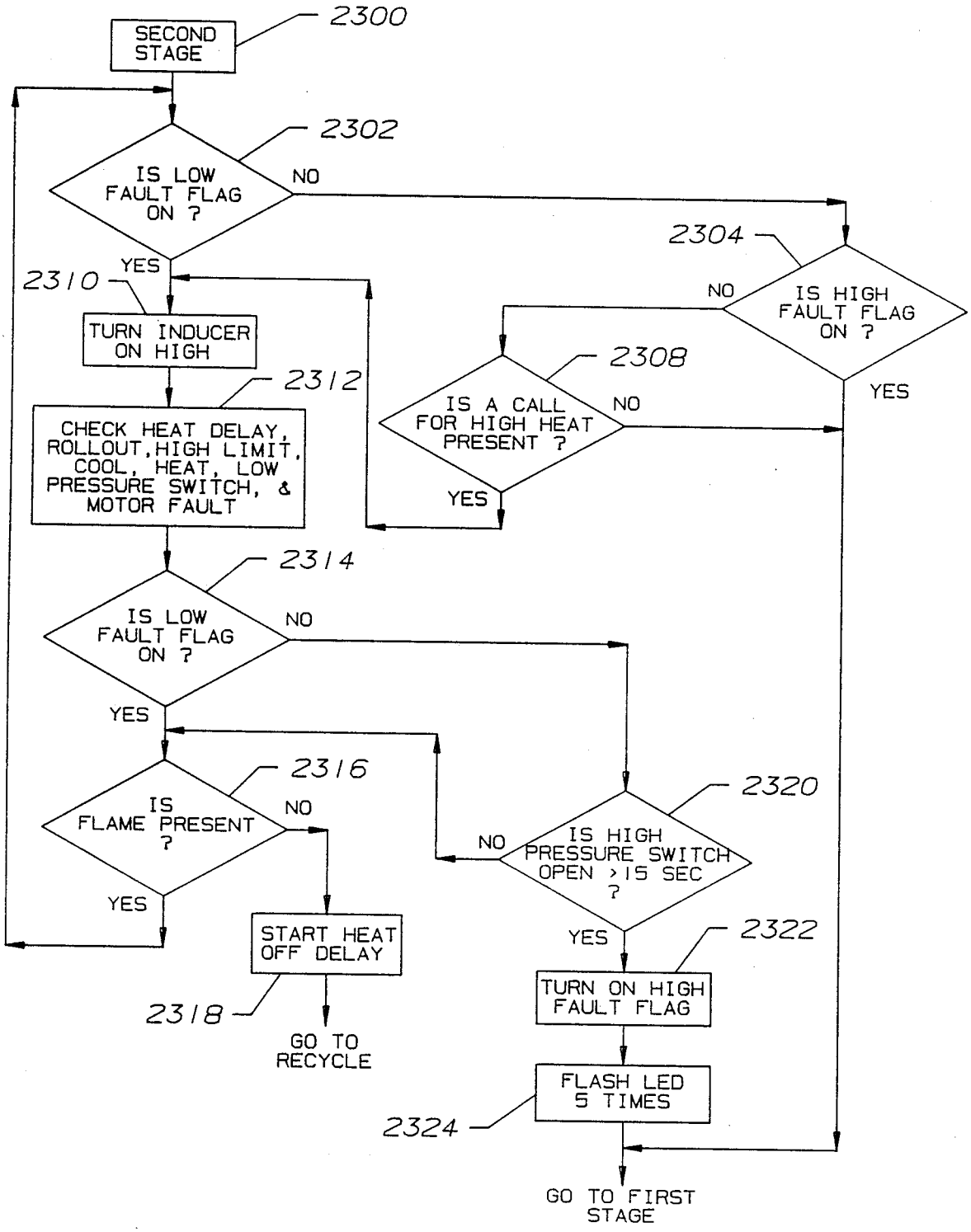
FIG. 23 is a flow chart of the SECOND STAGE portion of the heating cycle.

The high stage of heat or SECOND STAGE 2300 portion of the heating cycle is shown in FIG. 23. First, the control unit determines the state of the low fault flag in step 2302. If the low fault flag is on, then step 2310 is executed as described below. If the low fault flag is not on, then the control unit determines the state of the high fault flag in step 2304. If the high fault flag is also on, then the control unit begins to execute the FIRST STAGE portion of the heating cycle (described below). If the high fault flag is not on, the control unit next determines if a call for high heat is present in step 2308. If a call for high heat is not present, the control unit begins to execute the FIRST STAGE portion of the heating cycle.

If a call for high heat is present, or the low fault flag is on then the control unit turns the inducer fan on high speed in step 2310. Next, the control unit performs checks for HEAT DELAY, ROLLOUT, HIGH LIMIT, COOL, HEAT, LOW PRESSURE SWITCH, and MOTOR FAULT in step 2312. After the checks of step 2312, the control unit determines the state of the low fault flag in step 2314. If the low fault flag is on then the control unit directly determines if the flame sensor indicates the presence of flame in step 2316. If a flame is indicated then the control unit loops back to execute step 2302. If no flame is indicated then the control unit starts a heat off delay in step 2318 and begins to execute the RECYCLE routine.

When the low fault flag is not on in step 2314, the control unit determines if the high pressure switch has been open for greater than 15 seconds in step 2320. If not open for 15 seconds, then the control unit executes step 2316. If open for more than 15 seconds, the control unit turns on the high fault flag in step 2322, sets the LED to flash 5 times in step 2324, and begins to execute the FIRST STAGE portion of the heating cycle.

FIRST STAGE

Figure 24:
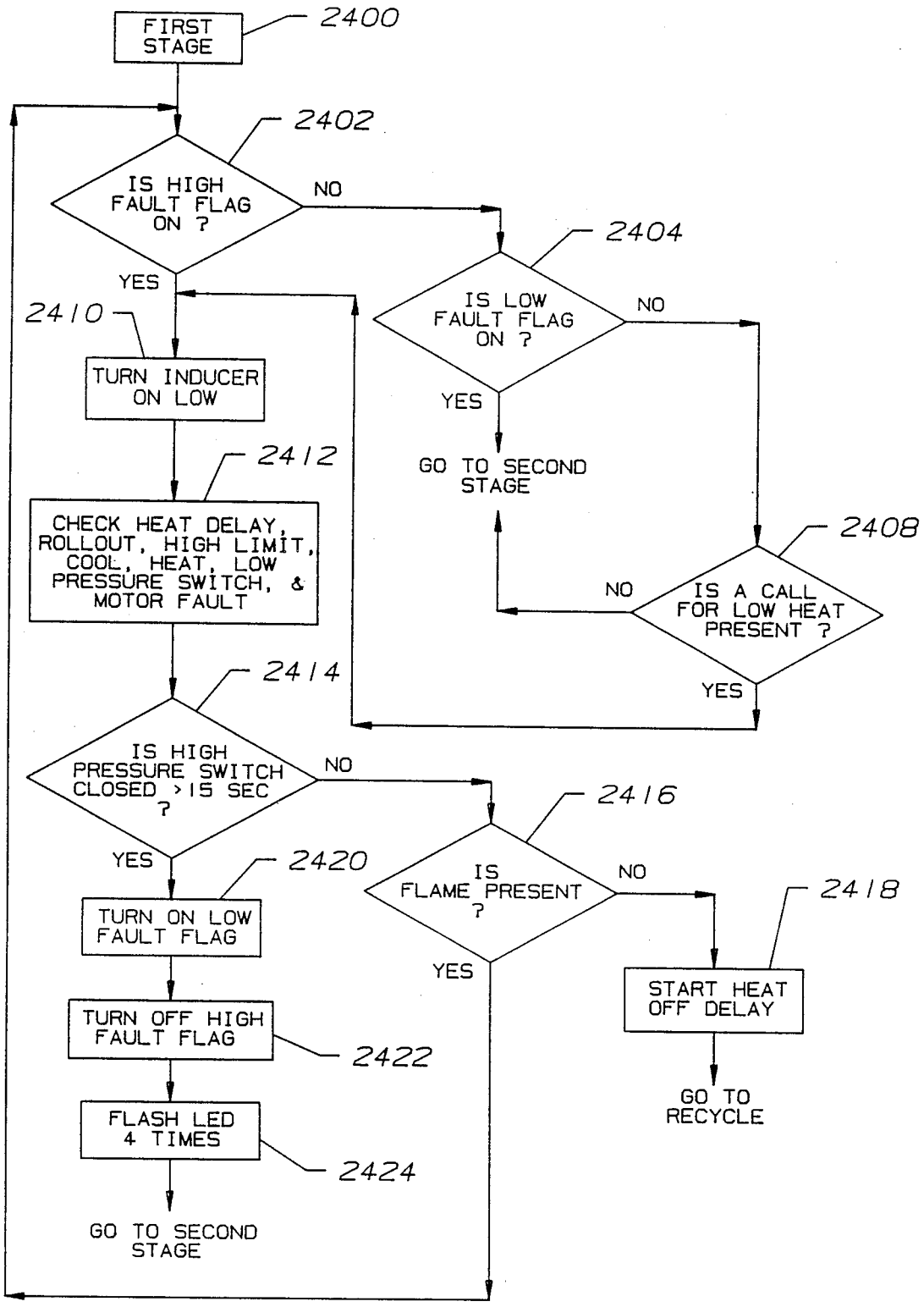
FIG. 24 is a flow chart of the FIRST STAGE portion of the heating cycle.

The low stage of heat or FIRST STAGE 2400 portion of the heating cycle is shown in FIG. 24. First, the control unit determines the state of the high fault flag in step 2402. If the high fault flag is on, then step 2410 is executed as described below. If the high fault flag is not on, then the control unit determines the state of the low fault flag in step 2404. If the low fault flag is also on, then the control unit executes the SECOND STAGE portion of the heating cycle. If the low fault flag is not on, the control unit next determines if a call for low heat is present in step 2408. If a call for low heat is not present the control unit begins to execute the SECOND STAGE portion of the heating cycle.

If a call for low heat is present, or the high fault flag is on, then the control unit turns the inducer fan on low speed in step 2410. Next, the control unit performs checks for HEAT DELAY, ROLLOUT, HIGH LIMIT, COOL, HEAT, LOW PRESSURE SWITCH, and MOTOR FAULT in step 2412. After the checks of step 2412, the control unit determines if the high pressure switch has been closed for more than 15 seconds. If the high pressure switch has not been closed over 15 seconds then the control unit directly determines if the flame sensor indicates the presence of flame in step 2416. If a flame is present, the control unit loops back to execute step 2402. If no flame is indicated, then the control unit starts a heat off delay in step 2418 before beginning to execute the RECYCLE portion of the heating cycle.

If the high pressure switch was closed for more than 15 seconds in step 2414, the control unit turns on the low fault flag in step 2420, turns off the high fault flag in step 2422, and sets the LED to flash 4 times before beginning to execute the SECOND STAGE portion of the heating cycle.

POSTPURGE

Figure 25:
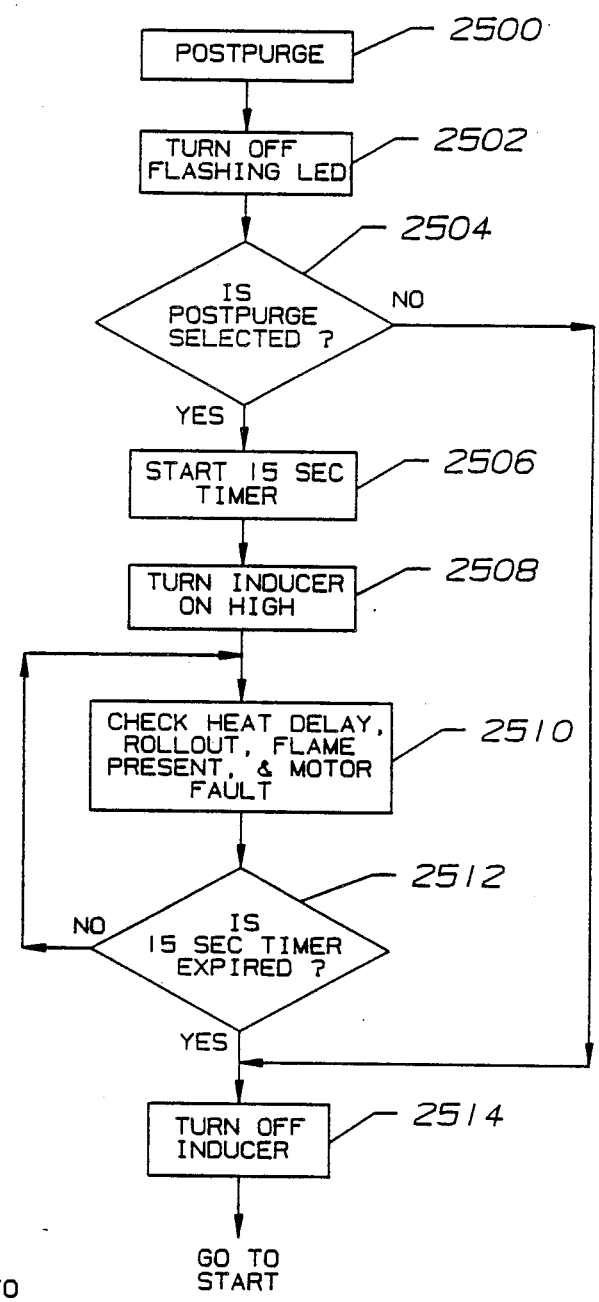
FIG. 25 is a flow chart of the POSTPURGE portion of the heating cycle.

The final portion of the heating cycle is POSTPURGE 2500 of FIG. 25. First, the control unit turns off any flashing of the LED in step 2502 and determines if the optional post-burning purge is selected in step 2504. If the postpurge is not selected, the control unit then executes step 2514.

If the postpurge is selected, then the control unit starts a 15 second timer in step 2506 and turns on the high speed of the inducer fan in step 2508. Next, the control unit performs checks for HEAT DELAY, ROLLOUT, FLAME PRESENT, and MOTOR FAULT in step 2510. After the checks of step 2510, the control unit determines if the 15 second timer has expired in step 2512. If unexpired the control unit loops to execute step 2510, and if expired the control unit turns off the inducer fan in step 2514 and begins to execute at START in the main operating loop.

While this invention has been described as having a preferred design, it can be further modified within the teachings of this disclosure. This application is therefore intended to cover any variations, uses, or adaptations of the invention following its general principles. This application is also intended to cover departures from the present disclosure as come within known or customary practice in the art to which this invention pertains and fall within the limits of the appended claims.

What is claimed is:

1. In a two stage furnace including a plenum, a gas burner, a gas valve having a low and high combustion operating setting, and an inducer fan having a low and high speed operating setting, a method of compensating for a restricted intake condition comprising the steps of:

providing a low and high pressure switch for determining if the air pressure inside the plenum indicates sufficient air is present for the gas burner to support low and high combustion, respectively;

operating the furnace at high combustion when high heat is enabled by operating the inducer fan at the high speed setting;

determining the state of said high pressure switch during high combustion including timing the duration of the stat changes of said high pressure switch;

switching the inducer fan to the low speed setting when said high pressure switch has indicated that insufficient air was present to support high combustion for a predetermined time period;

determining the state of said low pressure switch during low combustion;

switching the inducer fan to the high speed setting when the low pressure switch indicates that insufficient air is present to support low combustion.

2. The method of claim 1 wherein said second switching step terminates upon occurrence of a terminating event, one terminating event being when said high pressure switch indicates sufficient air is present for high combustion wherein the gas valve operates at high combustion, and another terminating event being when said low pressure switch indicates insufficient air is present for low combustion wherein the ga valve is shut down and the furnace disabled.

3. The method of claim 1 wherein the furnace includes a circulator fan and said second switching step includes activating the circulator fan of the furnace at a low speed setting.

4. A two stage furnace comprising:

a plenum having a combustion chamber and a heat exchanger, an inducer fan in communication with the combustion chamber, a circulator fan in communication with the heat exchanger, each of said inducer fan and said circulator fan having a low and high speed operating setting;

a gas burner in communication with said combustion chamber;

a gas valve fluidly connected to said gas burner, said gas valve having a low and high combustion operating setting;

an ignitor located adjacent said gas burner;

a low pressure switch operatively connected to said combustion chamber for indicating whether sufficient air is present for low combustion;

a high pressure switch operatively connected to said combustion chamber for indicating whether sufficient air is present for high combustion; and means for determining the state of said high pressure switch during high combustion including means for timing the duration of state changes of said high pressure switch, said determining means switching said inducer fan to said low speed setting when said high pressure switch has indicated that insufficient air was present to support high combustion for a predetermined time period; and means for switching said inducer fan to said high speed setting when said low pressure switch indicates that insufficient air is present to support low combustion.

* * * * *

UNITED STATES PATENT AND TRADEMARK OFFICE

CERTIFICATE OF CORRECTION

PATENT NO. : 4,982,721

DATED : January 8, 1991

INVENTOR(S) : Gregory A. Lynch

It is certified that error appears in the above-identified patent and that said Letters Patent is hereby corrected as shown below:

Column 1, line 57, delete "s" and substitute therefor --so--.

Column 4, line 24, delete "a" and substitute therefor --as--.

Column 7, line 61, delete "are" and substitute therefor --area--.

Column 11, line 21, delete "o" and substitute therefor --or--.
lines 30 and 31, delete "execute" and substitute therefor --executes--.

In The Claims

Column 21, Claim 1, line 25, delete "stat" and substitute therefor --state--.

Column 22, Claim 2, line 3, delete "ga" and substitute therefor --gas--.

Signed and Sealed this

Seventh Day of July, 1992

*Attest:*

DOUGLAS B. COMER

*Attesting Officer*

*Acting Commissioner of Patents and Trademarks*